US010260835B2

(12) United States Patent
Pulkrabek et al.

(10) Patent No.: US 10,260,835 B2
(45) Date of Patent: Apr. 16, 2019

(54) COCKING MECHANISM FOR A CROSSBOW

(71) Applicant: Ravin Crossbows, LLC, Superior, WI (US)

(72) Inventors: Larry Pulkrabek, Osceola, IA (US); Jay Engstrom, Port Wing, WI (US); Craig Thomas Yehle, Holmen, WI (US); Aaron Pellett, Alborn, MN (US); Matthew P. Haas, Duluth, MN (US); Fred H. Hunt, Athol, ID (US)

(73) Assignee: RAVIN CROSSBOWS, LLC, Superior, WI (US)

( * ) Notice: Subject to any disclaimer, the term of this patent is extended or adjusted under 35 U.S.C. 154(b) by 113 days.

(21) Appl. No.: 15/171,391

(22) Filed: Jun. 2, 2016

(65) Prior Publication Data

US 2016/0273870 A1 Sep. 22, 2016

Related U.S. Application Data

(63) Continuation of application No. 14/071,723, filed on Nov. 5, 2013, now Pat. No. 9,383,159, which is a continuation-in-part of application No. 13/799,518, filed on Mar. 13, 2013, now Pat. No. 9,255,753.

(60) Provisional application No. 61/820,792, filed on May 8, 2013.

(51) Int. Cl.

| | |
|---|---|
| ***F41B 5/12*** | (2006.01) |
| ***F41B 5/14*** | (2006.01) |
| *F41A 19/06* | (2006.01) |

(52) U.S. Cl.
CPC ..... *F41B 5/1469* (2013.01); *F41B 5/123* (2013.01); *F41A 19/06* (2013.01)

(58) Field of Classification Search
CPC ..... F41B 3/02; F41B 5/123; F41B 5/1469; F41B 5/00; F41B 5/12
See application file for complete search history.

(56) References Cited

U.S. PATENT DOCUMENTS 1,210,332 A * 12/1916 Kvistad ..... F41B 5/00 124/23.1
2,542,777 A * 2/1951 Loew ..... F41B 11/89 124/38
3,028,851 A * 4/1962 Drake ..... F41B 5/12 124/16
3,043,287 A * 7/1962 Nelson ..... F41B 5/12 124/25
3,509,863 A * 5/1970 Barker ..... F41B 7/003 124/16

(Continued)

OTHER PUBLICATIONS

U.S. Appl. No. 62/244,932, filed Oct. 22, 2015, String Guide for a Bow.

(Continued)

*Primary Examiner* — Melba Bumgarner
*Assistant Examiner* — Amir A Klayman

(57) ABSTRACT

A system for cocking mechanism for a crossbow that uses an elongated handle pivotally attached to the center support to move a traveler engaged with the draw string from a release configuration to a drawing configuration and into engagement with a trigger assembly. A ratcheting mechanism prevents the elongated handle from moving toward the open configuration as the crossbow is being cocked.

16 Claims, 35 Drawing Sheets

(56) References Cited

U.S. PATENT DOCUMENTS 3,670,711 A * 6/1972 Firestone ..... F41B 5/12 124/25
3,783,852 A * 1/1974 Shepherd ..... F41B 5/12 124/22
4,030,473 A 6/1977 Puryear
4,072,254 A * 2/1978 Cox ..... B05C 17/0123 222/391
4,192,281 A 3/1980 King
4,287,867 A 9/1981 Islas
4,388,914 A 6/1983 Cesin
4,479,480 A 10/1984 Holt
4,545,358 A 10/1985 Collins
4,565,182 A 1/1986 Barnett
4,587,944 A 5/1986 Barnett
4,594,994 A * 6/1986 Williams ..... F41B 5/12 124/25
4,603,676 A * 8/1986 Luoma ..... F41B 5/1469 124/25
4,693,228 A 9/1987 Simonds et al.
4,719,897 A * 1/1988 Gaudreau ..... F41B 5/1469 124/25
4,766,874 A 8/1988 Nishioka
4,796,598 A 1/1989 Jones
4,827,894 A * 5/1989 Schallberger ..... F41B 5/12 124/25
4,877,008 A 10/1989 Troubridge
4,919,107 A * 4/1990 Bunts ..... F41B 5/14 124/24.1
4,942,861 A 7/1990 Bozek
5,085,200 A 2/1992 Horton-Corcoran et al.
5,115,795 A * 5/1992 Farris ..... F41B 5/1469 124/25
5,205,267 A * 4/1993 Burdick ..... F41B 5/0094 124/24.1
5,220,906 A 6/1993 Choma
D337,145 S 7/1993 Horton-Corcoran
5,224,463 A 7/1993 Townsend
5,243,956 A 9/1993 Luehring
5,265,584 A 11/1993 Judson et al.
5,368,006 A 11/1994 McPherson
5,388,564 A 2/1995 Islas
5,445,139 A 8/1995 Bybee
5,522,373 A 6/1996 Barnett
5,596,976 A 1/1997 Waiser
5,598,829 A 2/1997 Bednar
5,630,405 A 5/1997 Nizov
5,649,520 A 7/1997 Bednar
5,660,159 A * 8/1997 Clayton ..... F41B 11/54 124/59
5,671,723 A 9/1997 Goff et al.
5,749,348 A * 5/1998 Oviedo-Reyes ..... F41B 5/12 124/25
5,823,172 A * 10/1998 Suggitt ..... F41B 5/12 124/25
5,884,614 A 3/1999 Darlington et al.
5,934,265 A 8/1999 Darlington
6,073,351 A 6/2000 Barnett
6,095,128 A 8/2000 Bednar
6,155,243 A 12/2000 Gallops
6,205,990 B1 3/2001 Adkins
6,267,108 B1 7/2001 McPherson et al.
6,286,496 B1 9/2001 Bednar
6,415,780 B1 7/2002 Proctor
6,425,386 B1 7/2002 Adkins
6,470,870 B1 10/2002 Schaar
6,571,785 B1 6/2003 Choma
6,640,528 B1 11/2003 Rowland
6,651,641 B1 11/2003 Bower et al.
6,705,304 B1 3/2004 Pauluhn
6,712,057 B2 3/2004 Andrews
6,736,123 B1 5/2004 Summers et al.
6,776,148 B1 8/2004 Islas
6,786,214 B2 9/2004 Andrews
6,792,931 B1 9/2004 Schaar
6,799,566 B1 10/2004 Malucelli
6,874,491 B2 4/2005 Bednar
6,874,492 B1 4/2005 Schavone
6,895,950 B2 * 5/2005 Gillet ..... A01K 81/04 124/20.3
6,901,921 B1 6/2005 Barnett
6,913,007 B2 7/2005 Bednar
6,968,836 B1 * 11/2005 Kees ..... F41B 5/1469 124/35.2
7,174,884 B2 2/2007 Kempf et al.
7,204,242 B2 4/2007 Dziekan
7,305,979 B1 12/2007 Yehle
7,328,693 B2 2/2008 Kempf
7,363,921 B2 4/2008 Kempf
D589,578 S 3/2009 Choma
D590,907 S 4/2009 Barnett
7,588,022 B2 9/2009 Chang
7,624,724 B2 12/2009 Bednar et al.
7,624,725 B1 12/2009 Choma
7,677,233 B2 3/2010 Bednar
7,708,001 B2 5/2010 Kempf
7,743,760 B2 6/2010 Woodland
7,748,370 B1 7/2010 Choma
7,753,041 B2 7/2010 Ogawa
7,770,567 B1 8/2010 Yehle
7,770,568 B1 8/2010 Yehle
7,784,453 B1 8/2010 Yehle
7,810,480 B2 10/2010 Shepley et al.
7,823,572 B2 11/2010 Anderson
7,832,386 B2 11/2010 Bednar et al.
7,832,387 B1 11/2010 Yehle
7,836,871 B2 11/2010 Kempf
7,997,258 B2 8/2011 Shepley et al.
8,016,703 B1 9/2011 Kronengold et al.
8,020,543 B2 9/2011 Maleski et al.
8,033,275 B2 10/2011 Bednar et al.
8,037,876 B1 10/2011 Yehle
8,042,530 B2 10/2011 Barnett
8,082,910 B1 12/2011 Yehle
8,091,540 B2 1/2012 Matasic et al.
8,104,461 B2 1/2012 Kempf
8,181,638 B1 5/2012 Yehle
8,191,541 B2 6/2012 Shaffer et al.
8,240,299 B2 * 8/2012 Kronengold ..... F41A 11/02 124/25
8,312,869 B2 * 11/2012 Gillet ..... A01K 81/00 124/20.3
8,434,463 B2 5/2013 Bednar et al.
8,439,025 B2 5/2013 Shaffer et al.
8,439,026 B1 * 5/2013 Kilian ..... F41B 5/1469 124/35.2
8,443,790 B2 5/2013 Pestrue
8,459,244 B2 6/2013 Yehle
8,469,012 B2 6/2013 Bednar et al.
8,469,013 B1 6/2013 Obteshka et al.
8,479,719 B2 7/2013 Bednar et al.
8,573,192 B2 11/2013 Bednar et al.
8,578,918 B1 11/2013 Islas
8,635,994 B1 1/2014 Yehle
8,651,095 B2 2/2014 Islas
8,662,061 B1 3/2014 Darlington
8,671,923 B2 3/2014 Goff et al.
8,739,769 B1 6/2014 Obteshka et al.
8,752,535 B2 6/2014 Barber et al.
8,763,595 B1 7/2014 Bednar et al.
8,794,225 B2 8/2014 Bednar et al.
8,857,420 B2 10/2014 Bednar
8,899,217 B2 12/2014 Islas
8,950,385 B1 2/2015 Khoshnood
8,978,634 B2 3/2015 Darlington
8,985,091 B2 3/2015 Miao
9,004,053 B1 4/2015 Anderson
9,022,013 B2 5/2015 Trpkovski
9,097,485 B2 8/2015 Lipowski
9,140,516 B1 9/2015 Hyde
9,212,862 B2 12/2015 Biafore et al.
9,255,753 B2 2/2016 Pulkrabek
9,255,754 B1 2/2016 Kempf
9,255,755 B1 2/2016 Kempf

(56) References Cited

U.S. PATENT DOCUMENTS

| | | | | |
|---|---|---|---|---|
| 9,255,756 | B1 | 2/2016 | Wu et al. | |
| 9,297,604 | B1 | 5/2016 | Sidebottom et al. | |
| 9,303,944 | B2 | 5/2016 | Barber | |
| 9,335,115 | B2 | 5/2016 | Bednar et al. | |
| 9,341,430 | B2 | 5/2016 | McPherson | |
| 9,341,432 | B1 * | 5/2016 | Wohleb | F16H 25/20 |
| 9,341,434 | B2 | 5/2016 | McPherson et al. | |
| 9,347,731 | B1 | 5/2016 | Chang | |
| 9,354,015 | B2 | 5/2016 | Yehle | |
| 9,360,268 | B2 | 6/2016 | Khoshnood | |
| 9,383,159 | B2 | 7/2016 | Pulkrabek et al. | |
| 9,404,701 | B2 | 8/2016 | Lipowski | |
| 9,404,705 | B2 | 8/2016 | Kennedy | |
| 9,417,029 | B1 | 8/2016 | Chang | |
| 9,423,203 | B2 | 8/2016 | Simonds | |
| 9,435,605 | B2 | 9/2016 | McPherson et al. | |
| 9,453,699 | B1 | 9/2016 | Barnett | |
| 9,464,861 | B1 | 10/2016 | Hughes et al. | |
| 9,476,665 | B2 | 10/2016 | McPherson | |
| 9,500,433 | B2 | 11/2016 | McPherson | |
| 9,506,715 | B2 | 11/2016 | Hughes | |
| 9,523,549 | B1 | 12/2016 | Hughes | |
| 9,528,789 | B2 | 12/2016 | Biafore et al. | |
| 9,638,487 | B1 * | 5/2017 | Liu | F41B 5/12 |
| 2005/0022799 | A1 | 2/2005 | Bednar | |
| 2007/0028907 | A1 | 2/2007 | Bednar et al. | |
| 2008/0251058 | A1 | 10/2008 | Colley | |
| 2009/0078243 | A1 | 3/2009 | Bednar | |
| 2009/0178657 | A1 | 7/2009 | Shaffer | |
| 2009/0194086 | A1 | 8/2009 | Kempf | |
| 2009/0223500 | A1 | 9/2009 | Stanziale | |
| 2010/0012108 | A1 | 1/2010 | Bednar et al. | |
| 2010/0031945 | A1 | 2/2010 | Shaffer et al. | |
| 2010/0154768 | A1 | 6/2010 | Bednar et al. | |
| 2010/0170487 | A1 | 7/2010 | Kronengold et al. | |
| 2010/0170488 | A1 | 7/2010 | Rasor et al. | |
| 2010/0186728 | A1 | 7/2010 | Bednar et al. | |
| 2010/0269807 | A1 | 10/2010 | Kempf | |
| 2011/0041820 | A1 | 2/2011 | Stanziale | |
| 2011/0308508 | A1 | 5/2011 | Islas | |
| 2011/0203561 | A1 | 8/2011 | Shaffer et al. | |
| 2011/0232619 | A1 | 9/2011 | Bednar et al. | |
| 2011/0253118 | A1 | 10/2011 | Kempf | |
| 2012/0006311 | A1 | 1/2012 | Bednar et al. | |
| 2012/0080021 | A1 | 4/2012 | Shaffer et al. | |
| 2015/0013654 | A1 | 1/2015 | Bednar et al. | |
| 2016/0223285 | A1 | 9/2016 | Yehle | |

OTHER PUBLICATIONS

U.S. Appl. No. 15/098,577, filed Apr. 14, 2016, Anti-Dry Fire System for a Crossbow.
U.S. Appl. No. 15/395,705, filed Dec. 30, 2016, Torque Control System for Cocking a Crossbow.
U.S. Appl. No. 15/395,794, filed Dec. 30, 2016, Cocking System for a Crossbow.
U.S. Appl. No. 15/395,835, filed Dec. 30, 2016, Crossbow.
U.S. Appl. No. 13/799,518, filed Mar. 13, 2013, Energy Storage Device for a Bow, U.S. Pat. No. 9,255,753, Feb. 9, 2016.
U.S. Appl. No. 61/820,792, filed May 8, 2013, Cocking Mechanism for a Bow.
U.S. Appl. No. 14/071,723, filed Nov. 5, 2013, De-Cocking Mechanism for a Bow.
U.S. Appl. No. 15/171,391, filed Jun. 2, 2016, Cocking Mechanism for a Crossbow.
U.S. Appl. No. 14/107,058, filed Dec. 16, 2013, String Guide System for a Bow, U.S. Pat. No. 9,354,015, May 31, 2016.
U.S. Appl. No. 15/098,537, filed Apr. 14, 2016, Crossbow.
U.S. Appl. No. 15/098,557, filed Apr. 14, 2016, String Control System for a Crossbow.
U.S. Appl. No. 15/098,568, filed Apr. 14, 2016, Reduced Friction Trigger for a Crossbow.

* cited by examiner

COCKING MECHANISM FOR A CROSSBOW

RELATED APPLICATIONS

The present application is a continuation of U.S. patent application Ser. No. 14/071,723 (Allowed), entitled De-Cocking Mechanism for a Bow, filed Nov. 5, 2013, which is continuation-in-part of U.S. patent application Ser. No. 13/799,518 (U.S. Pat. No. 9,255,753), entitled Energy Storage Device for a Bow, filed Mar. 13, 2013 and claims the benefit of U.S. Provisional Application No. 61/820,792, entitled Cocking Mechanism for a Bow, filed May 8, 2013, the entire disclosures of which are hereby incorporated by reference.

FIELD OF THE INVENTION

The present disclosure is directed to a cocking mechanism for a crossbow that uses an elongated handle pivotally attached to the center support to move a traveler engaged with the draw string from a release configuration to a drawing configuration and into engagement with a trigger assembly. A ratcheting mechanism prevents the elongated handle from moving toward the open configuration as the crossbow is being cocked.

BACKROUND OF THE INVENTION

Bows have been used for many years as a weapon for hunting and target shooting. More advanced bows include cams that increase the mechanical advantage associated with the draw of the bowstring. The earns are configured to yield a decrease in draw force near full draw.

In order to cock a bow in preparation for firing the same, the string must be pulled toward a trigger assembly. Sufficient force must be exerted to bend the limbs of the bow which carry the string. Once the string is engaged by the trigger assembly, the trigger safety is activated. Then an arrow may be loaded in the crossbow with its back end in contact with the string, the trigger safety may be disengaged, and the trigger pulled to release or shoot the arrow.

The force required to cock the bow in this fashion has consistently been a problem for users. Specifically, despite the use of compound bows with cams that attach the string to the limbs, the force required to cock a typical bow often exceeds one hundred pounds. As a result, many devices have been designed to assist in the cocking of a crossbow.

The most sophisticated of these devices is an essentially automatic cocking machine which is attached to the stock of a bow and by means of a motorized rope system. In lieu of being motorized, these cocking devices can also be operated by means of a hand crank. While these automatic or hand cranked devices operate satisfactorily, they are somewhat expensive, add additional weight, and they are bulky when attached to the stock of the bow.

Various crossbow cocking systems are shown, for example, in U.S. Pat. Nos. 4,942,861 (Bozek), 5,243,956 (Luehring), 7,624,725 (Choma), and 8,439,024 (Barnett).

BRIEF SUMMARY OF THE INVENTION

The present disclosure is directed to a cocking mechanism for a crossbow. An elongated handle is pivotally attached to the center support and moves a traveler engaged with the draw string from a release configuration to a drawing configuration and into engagement with a trigger assembly.

A ratcheting mechanism prevents the elongated handle from moving toward the open configuration as the crossbow is being cocked.

One embodiment is directed to a cocking mechanism for a crossbow including a center support with a longitudinal axis. An energy storage assembly is coupled to the center support with a draw string that extends across the center support coupled to the energy storage assembly. An elongated handle is pivotally attached to the center support at location near a distal end of the center support. The cocking mechanism includes a traveler that slides along the center support back and forth along the longitudinal axis. An arm pivotally couples the elongated handle to the traveler, so that as the elongated handle is moved to an open configuration the arm advances the traveler to the distal end of the center support and into engagement with the draw string in a release configuration. As the elongated handle is moved to a closed configuration the arm moves the draw string from the released configuration to a drawn configuration, and into engagement with a trigger assembly located near a proximal end of the center support.

In one embodiment the center support includes an opening that receives a portion of the cocking mechanism. An accessory rail suitable for attaching crossbow accessories to the crossbow is optionally attached to the elongated handle. The traveler preferably including a finger that captures the draw string and moves it into engagement with the trigger assembly. A latch retains the elongated handle in the closed configuration.

A ratcheting mechanism is preferably provided to prevent the elongated handle from moving toward the open configuration as the elongated handle is being moved toward the closed configuration. In one embodiment, the ratcheting mechanism is located at the pivotal intersection of the arm with the elongated handle. In another embodiment the ratcheting mechanism includes a toothed member mounted to the elongated handle and a pawl pivotally attached to the arm. The pawl is biased into engagement with teeth on the toothed member so the pawls slide sequentially into and out of engagement with the teeth as the elongated handle is moved from the open configuration to the closed configuration, while positively engaging with the teeth to prevent movement of the elongated handle toward the open configuration. An actuator located near a proximal end of the elongated handle is coupled to the pawl so that actuating the actuator disengages the pawl from the teeth.

One embodiment includes a latch that retains the elongated handle in the closed configuration and a ratcheting mechanism that prevents the elongated handle from moving to the open configuration as the elongated handle is being moved toward the closed configuration. An actuator located near a proximal end of the elongated handle is coupled to the latch and the ratcheting mechanism so that actuating the actuator releases both the latch and the ratcheting mechanism.

In one embodiment, the energy storage assembly includes at least first and second limbs attached to the center support. First and second power cables extend between the first and second limbs and the center support, respectively. The first and second power cables preferably do not cross over the center support.

The present disclosure is also directed to a cocking mechanism for a crossbow including a center support with a longitudinal axis and at least first and second limbs attached to the center support. First and second power cables extend between the first and second limbs and the center support, respectively, such that the first and second power cables do not cross over the center support. An elongated handle is pivotally attached to the center support at location near a distal end. An arm pivotally couples the elongated handle to the traveler that slides support back and forth along the longitudinal axis of the center support. As the elongated handle is moved to an open configuration the arm advances the traveler to the distal end of the center support and into engagement with the draw string in a release configuration. As the elongated handle is moved to a closed configuration the arm moves the draw string from the released configuration to a drawn configuration, and into engagement with a trigger assembly located near a proximal end of the center support.

The present disclosure is also directed to a method of operating a cocking mechanism for a crossbow. The crossbow includes a center support with a longitudinal axis and an energy storage assembly engaged with the center support having a draw string that extends across the center support coupled to the energy storage assembly. The method includes the step of moving an elongated handle pivotally attached near a distal end of the center support toward an open configuration. The elongated handle is pivotally coupled to a traveler by an arm. The traveler slides along the longitudinal axis of the center support to the distal end of the center support. The traveler is coupled to the draw string in a released configuration. The elongated handle is moved to a closed configuration to move the traveler and the draw string along the axis toward a drawn configuration. The draw string is engaged with a trigger assembly located near a proximal end of the center support.

The method includes locating a portion of the cocking mechanism in an opening in the center support when in the closed configuration. A ratcheting mechanism is engaged during the step of moving the elongated handle to a closed configuration to prevent the elongated handle from moving toward the open configuration.

In another method, a pawl attached to the arm is engaged with teeth on the toothed member attached to the elongated handle so the pawls slide sequentially into and out of engagement with the teeth as the elongated handle is moved from the open configuration to the closed configuration. The pawl prevents movement of the elongated handle toward the open configuration. Actuating an actuator located near a proximal end of the elongated handle disengages the pawl from the teeth so the elongated handle can be moved toward the open configuration.

DETAILED DESCRIPTION OF THE INVENTION

FIGS. 1-4 are perspective views of an energy storage device 50 for a projectile launching system in accordance with an embodiment of the present disclosure. Center support 52 includes a first pair of distal and proximal limb mounts 54A, 56A located on a first side 58A of center plane 60 and a second pair of distal and proximal limb mounts 54B, 56B located on a second side 58B on the second side of the center plane 60.

The center support 52 can be a single piece or a multi-component construction. In the illustrated embodiment, the center support 52 includes a pair of machined center rails 52A, 52B coupled together with fasteners, and a pair of finger guards 53A, 53B also attached to the center rails 52A, 52B using fasteners. The components 52, 53 are preferably constructed from a light weight metal, such as high grade aluminum. As will be discussed below, the center support 52 will include a variety of additional features, such as cut-outs and mounting holes, to accommodate other components such as a trigger mechanism, cocking mechanism, stock, arrow storage, and the like (see e.g., FIG. 12B).

Figure 3:
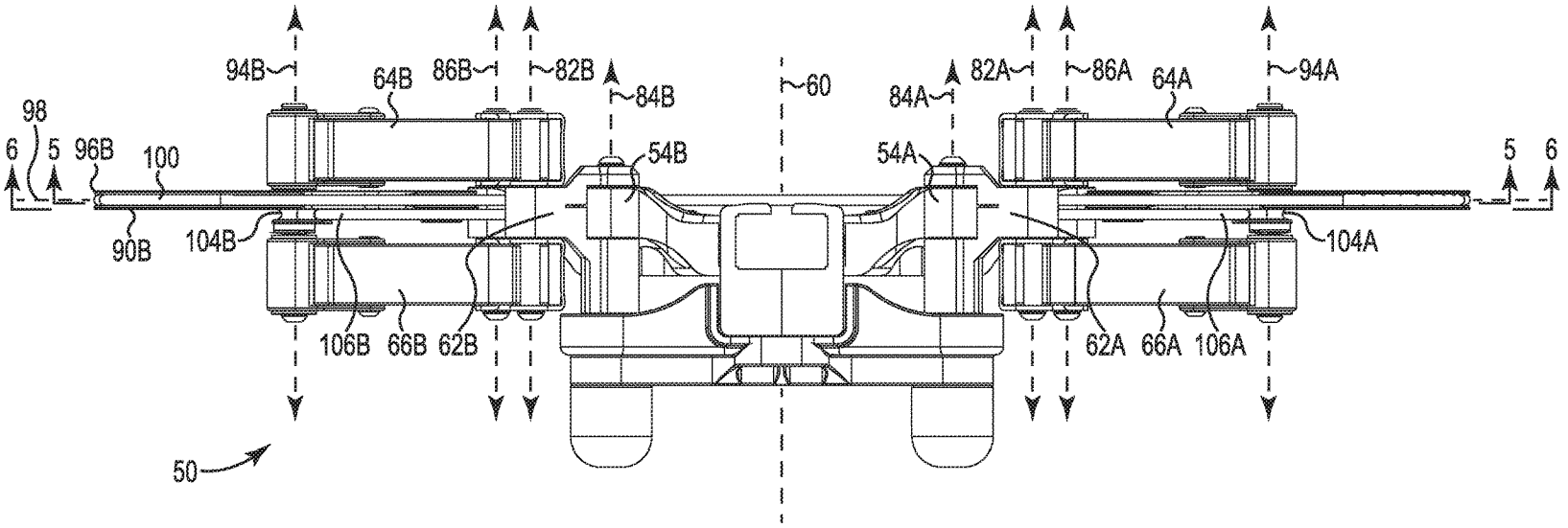
FIG. 3 is a front view of the energy storage system of FIG. 1.
Figure 4:
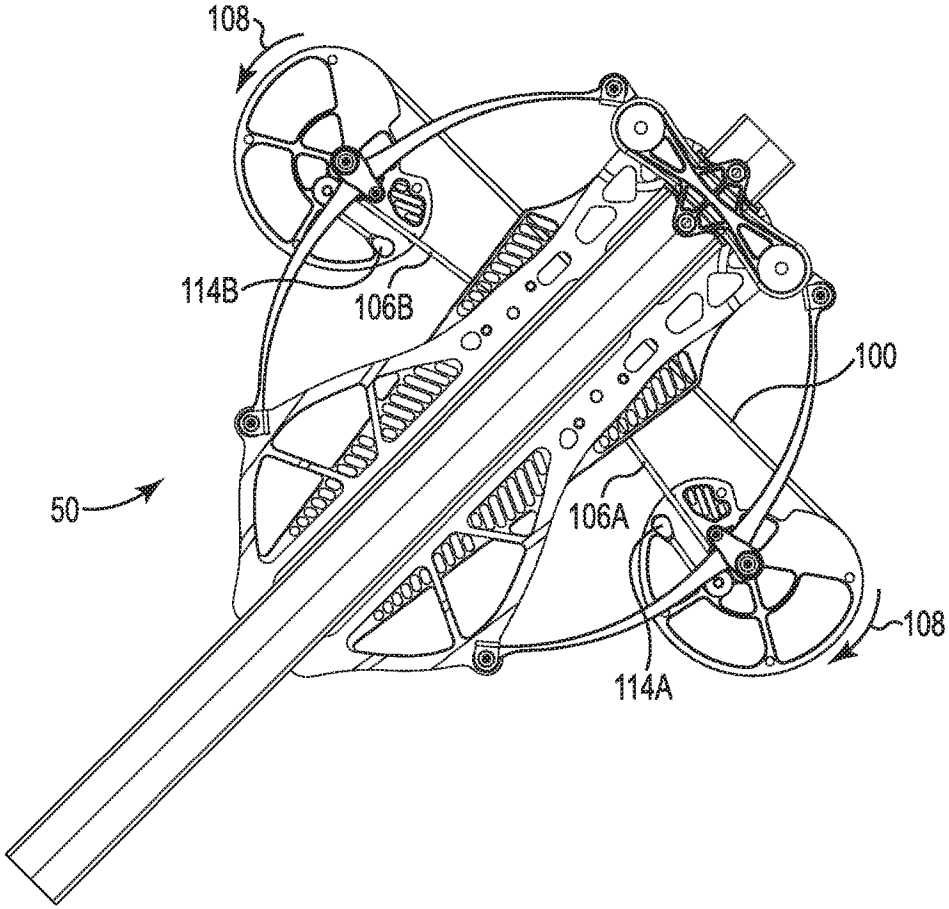
FIG. 4 is a bottom view of the energy storage system of FIG. 1.

In the illustrated embodiment, limbs 64A, 66A are located on first side 58A of the center plane 60 and limbs 64B, 66B are located on the second side 58B. Proximal portions 68A, 68B ("68") of the limbs 64A, 66A are coupled to the proximal limb mount 54A in the finger guard 53A, such as by pivot pin 70 and pivot brackets 72. Proximal portions 74A, 74B ("74") of the limbs 64B, 66B are coupled to the proximal limb mounts 56B in the finger guard 53B by pivot pin 70 and pivot brackets 72. As illustrated in FIG. 3, the proximal portions 68, 74 rotate on axes 86A, 86B ("86") relative to the center support 52 to provide a pivoting or rotating coupling.

In the illustrated embodiment, translation arms 62A, 62B ("62") arc pivotally attached to the distal limb mounts 54A, 54B in the finger guards 53A, 53B, respectively. Distal portions 76A, 76B ("76") of the limbs 64A, 66A are coupled to the translation arm mount 78A, such as by pivot pin 70 and pivot brackets 72. Distal portions 80A, 80B ("80") of the limbs 64B, 66B are coupled to the translation arm mount 78B by pivot pin 70 and pivot brackets 72. The distal portions 76, 80 rotate on axes 82A, 82B, ("82") relative to the translation arm mounts 78A, 78B, respectively. The translation arms 62A, 62B rotate on axes 84A, 84B ("84"), respectively, relative to the center support 52 (see, FIG. 3). The translation arms 62 to provide a linkage coupling between the limbs 64, 66 and the center support 52.

As used herein, "coupled" or "coupling" refers to a connection between a limb and a center support. Both positive coupling and dynamic coupling are possible. "Positively coupled" or "positive coupling" refers to a limb continuously engaged with a center support. "Dynamically coupled" or "dynamic coupling" refers to a limb engage with a center support only when a certain level of tension is applied to a draw string. The coupling can be a rigid coupling, a sliding coupling, a pivoting coupling, a linkage coupling, a rotating coupling, an elastomeric coupling, or a combination thereof.

Figure 1:
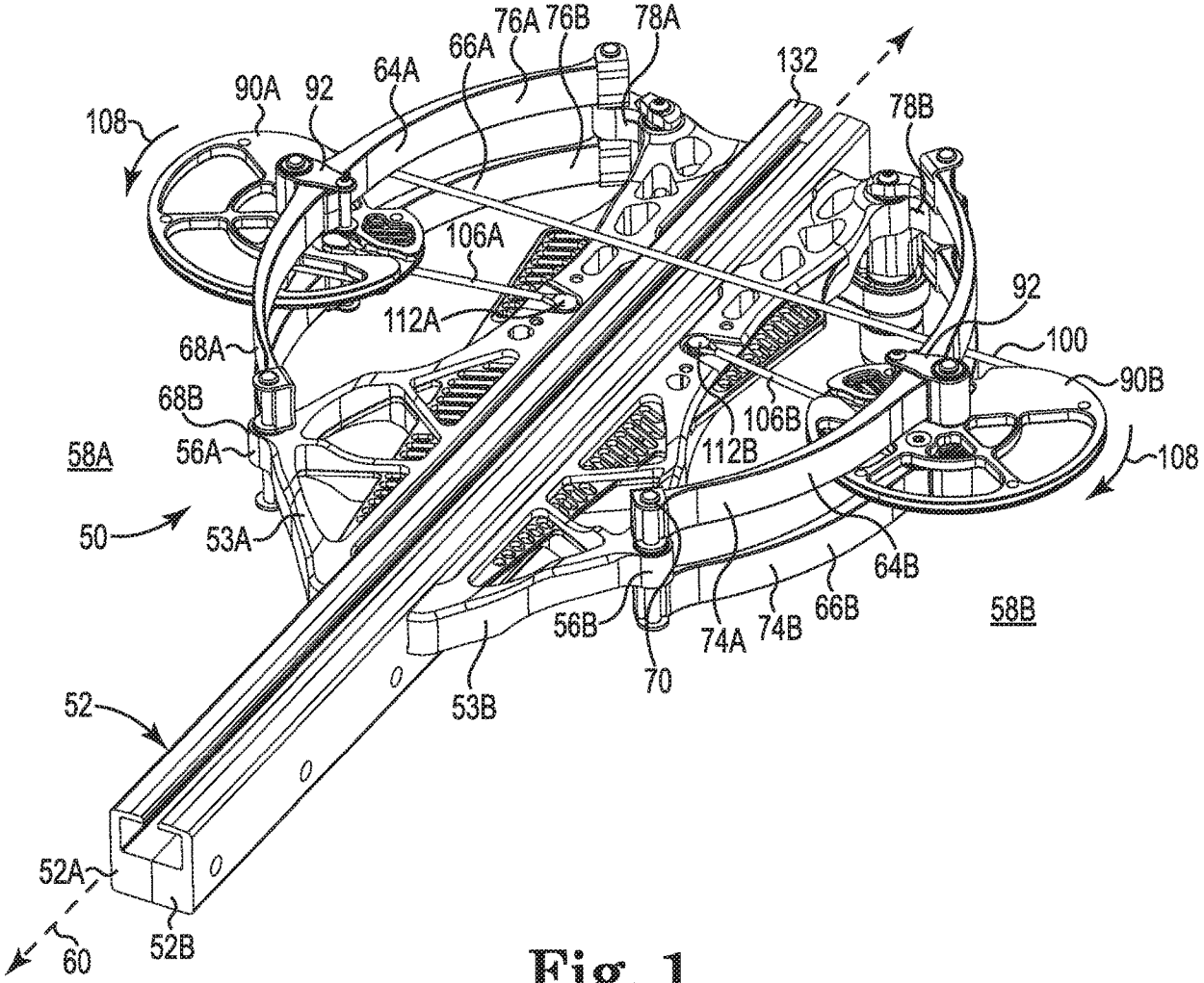
FIG. 1 is a perspective view of an energy storage system in accordance with an embodiment of the present disclosure.
Figure 2:
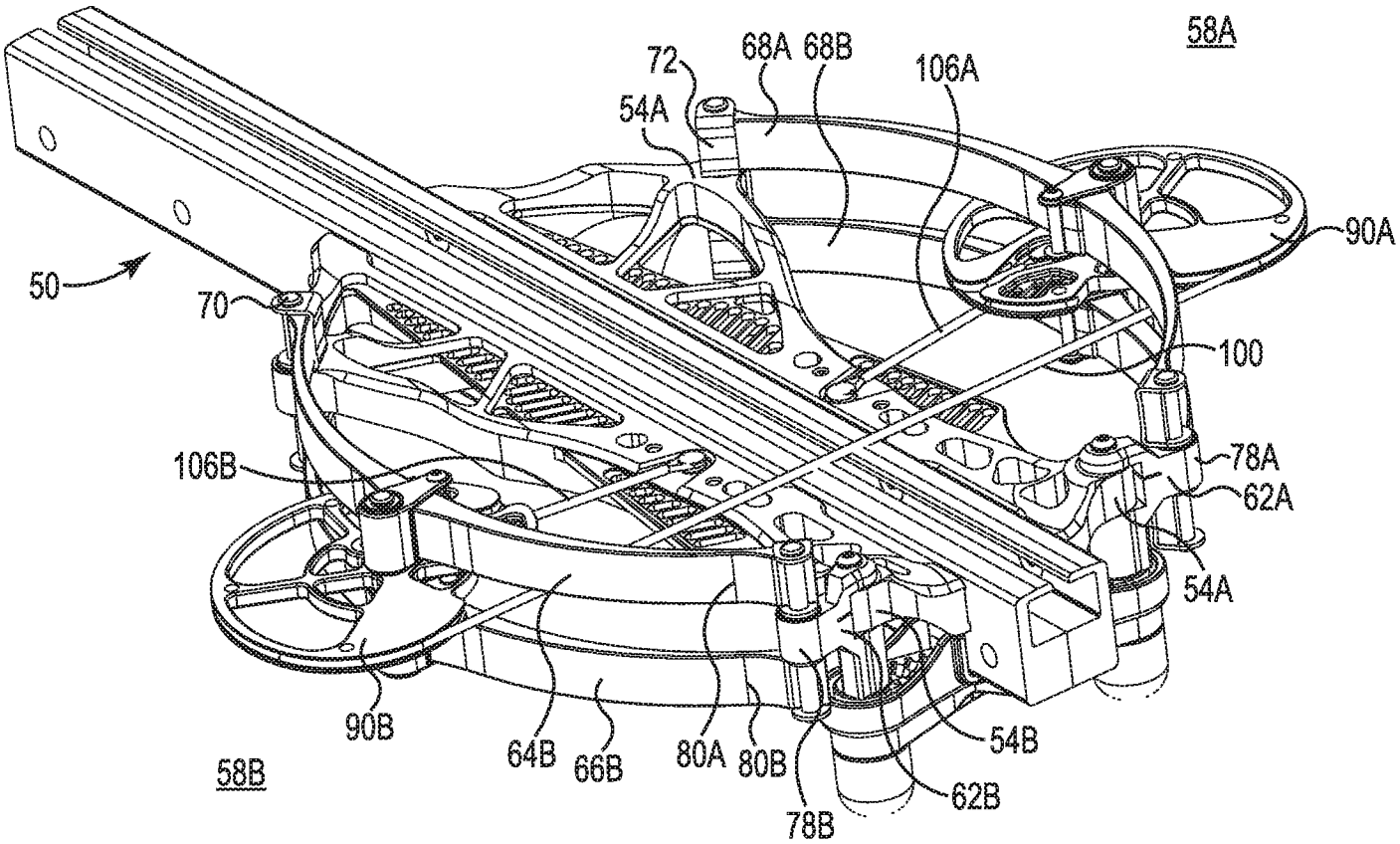
FIG. 2 is an alternate perspective view of the energy storage system of FIG. 1.

For example, in the embodiment of FIG. 1, both ends of the limbs 64, 66 are positively coupled to the center support 52. The proximal ends 68, 74 use a rotating or pivoting, coupling and the distal portions 76, 80 use a linkage coupling.

Figure 8:
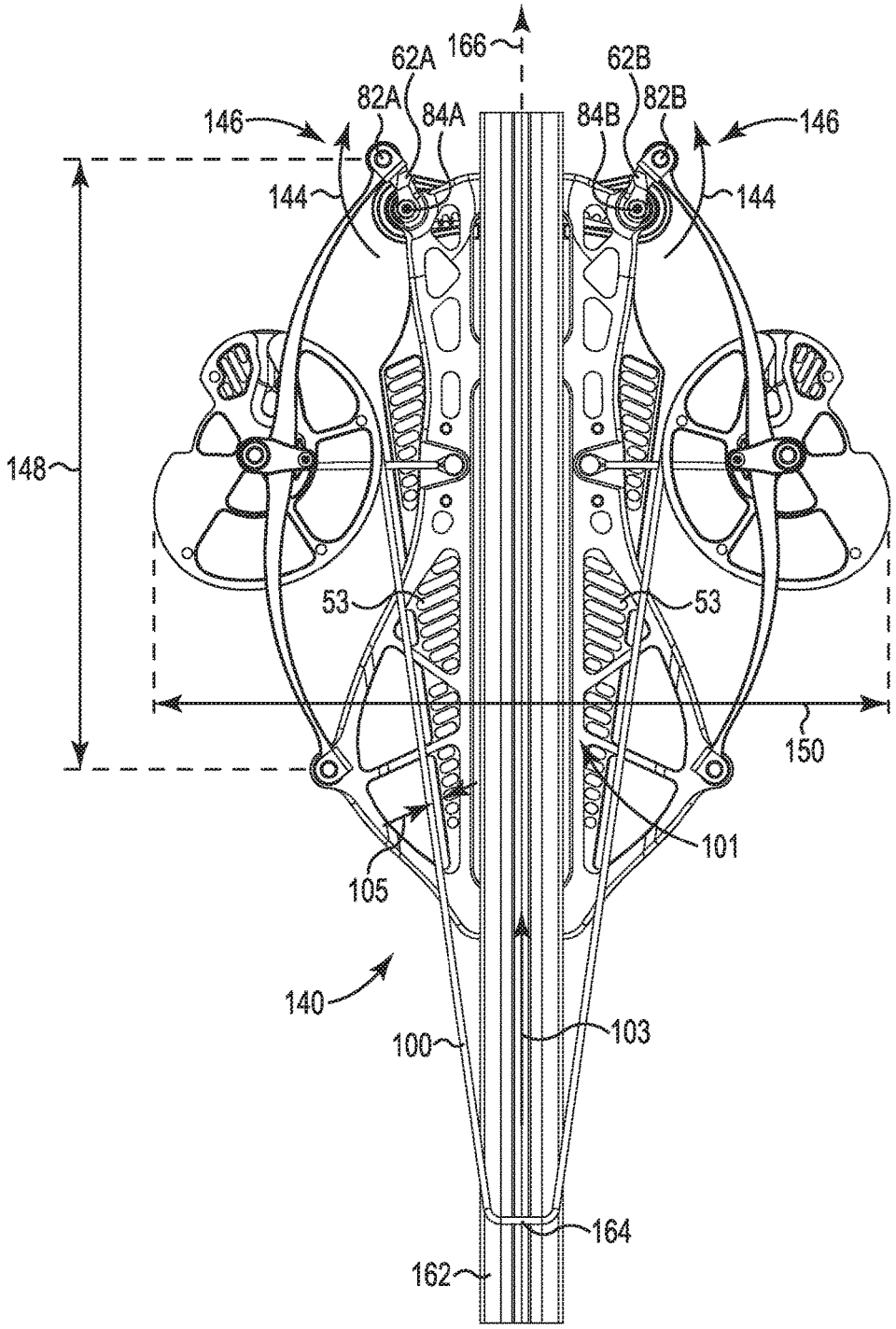
FIG. 8 is a top view of the energy storage system of FIG. 1 in a drawn configuration in accordance with the embodiment of the present disclosure.

As illustrated in FIG. 8, the inward deformation of the limbs 64, 66 forces the translation arms 62 to rotate in distal directions 144 around pivot axes 84 to extended position 146. The translation arms 62 provide limb relief between the distal portions 74 and the proximal portion 68 of the limbs 64, 66. As used herein, "limb relief" means displacement between a proximal portion of a limb relative to a distal portion of the limb when a certain level of tension is applied to a draw string. The displacement can be translation, rotation, flexure, or a combination thereof, occurring at either or both ends of the limbs. The limb relief is typically provided by the couplings and/or the center support 52.

Various structures for providing limb relief are discussed herein. For example, limb relief can be provided by locating pivot arms 62 between proximal portions 68, 74 of the limbs 64, 66 and the proximal limb mounts 54. In yet another embodiment, limb relief is provided by pivot arms 62 located at both the distal portions 76, 80 and the proximal portions 68, 74 of the limbs 64, 66.

In an alternate embodiment, the translation arms 62 are replaced with elastomeric members that are rigidly attached to the finger guard 53. Limb relief is achieved by elastic deformation of the elastomeric translation arms. In another embodiment, limb relief is provided by a combination of deformation and rotation of the elastomeric translation arms 62 (see e.g., FIG. 16).

In yet another embodiment, one or both of the distal and proximal limb mounts 54, 56 are configured as slots with an elastomeric bushing to provide the limb relief.

Figure 19B:
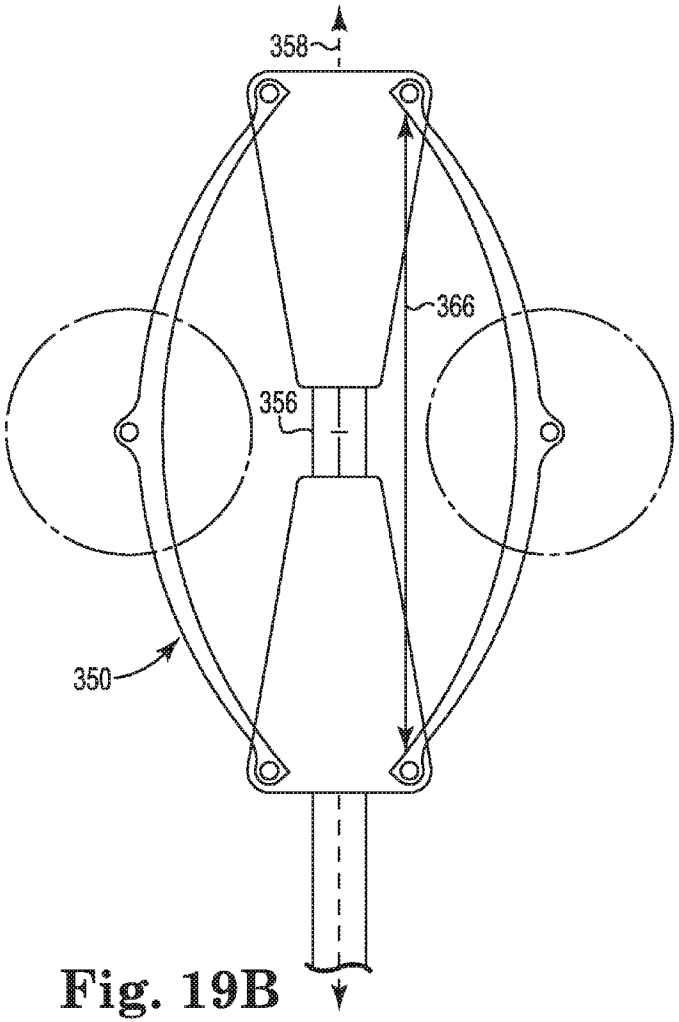
FIGS. 19A and 19B an energy storage portion for a bow with a center support that provides limb relief in accordance with an embodiment of the present disclosure.
Figure 19A:
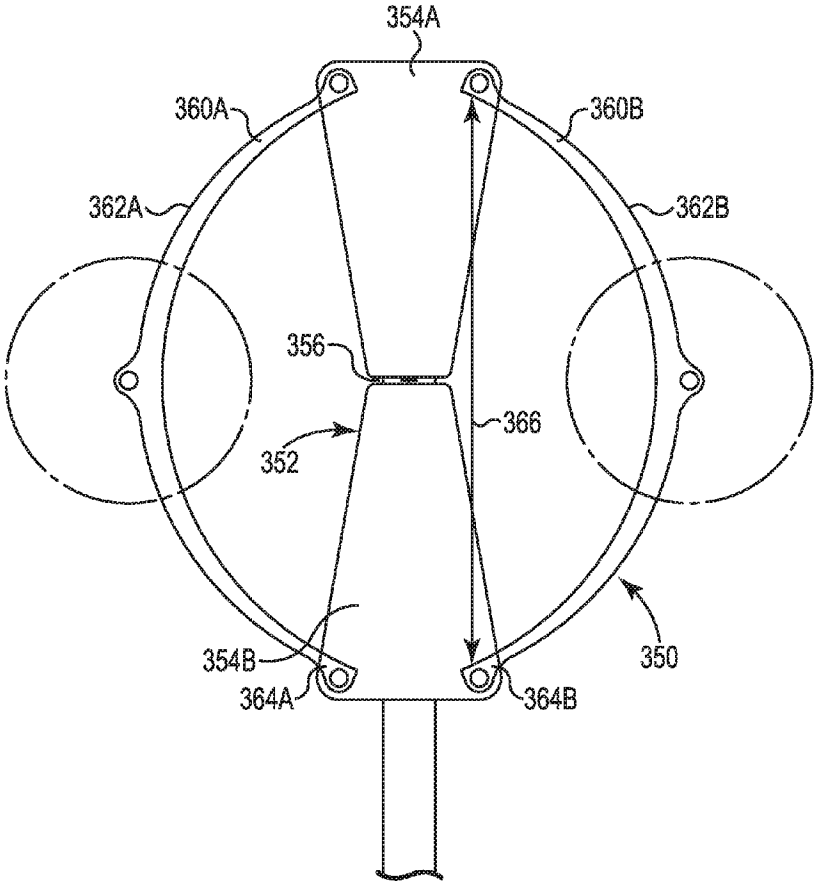

In yet another embodiment, limb relief is provided by the center support 52 (see e.g., FIGS. 19A and 19B).

First pulley assembly 90A is pivotally coupled to the first limbs 64A, 66A at a location between the proximal and distal portions 68, 76. Second pulley assembly 90B is pivotally coupled to the second limbs 64B, 66B at a location between the proximal and the distal portions 74, 80. As best illustrated in FIG. 3, the first and second pulley assemblies 90A, 90B rotate around axes 94A, 94B. In the illustrated embodiment, the first pulley assembly 90A is located between the limbs 64A, 66A and the second pulley assembly 90B is located between the limbs 64B, 66B.

As used herein, the term "pulley" is refers generically to a member rotating around an axis that is designed to support movement of a flexible member, such as a rope, string, belt, chain, and the like. Pulleys typically have a groove, channel or journal located between two flanges around at least a portion of its circumference that guides the flexible member. Pulleys can be round, such as a drum or a sheave, or non-round, such as a cam. The axis of rotation can be located concentrically or eccentrically relative to the pulley.

As best illustrated in FIG. 3, the pulleys 90A, 90B include draw string journals 96A, 96B ("96") configured to receive draw string 100. The draw string journals 96 are located in plane 98 that is located above top surface 102 of the center support 52. As will be discussed below, the draw string journals 96 are arranged so that the string 100 travels close to the top surface 102 of the center support 52 between a release configuration 130 and a drawn configuration 140 (See FIGS. 7 and 8). The pulleys 90 also include power string journals 104A, 104B ("104") configured to receive power strings 106A, 106B that are located below and generally parallel to the draw string journals 96. As used herein, "string" refers generically to any flexible member, such as woven and non-woven filaments of synthetic or natural materials, cables, belts, chains, and the like.

Figure 5:
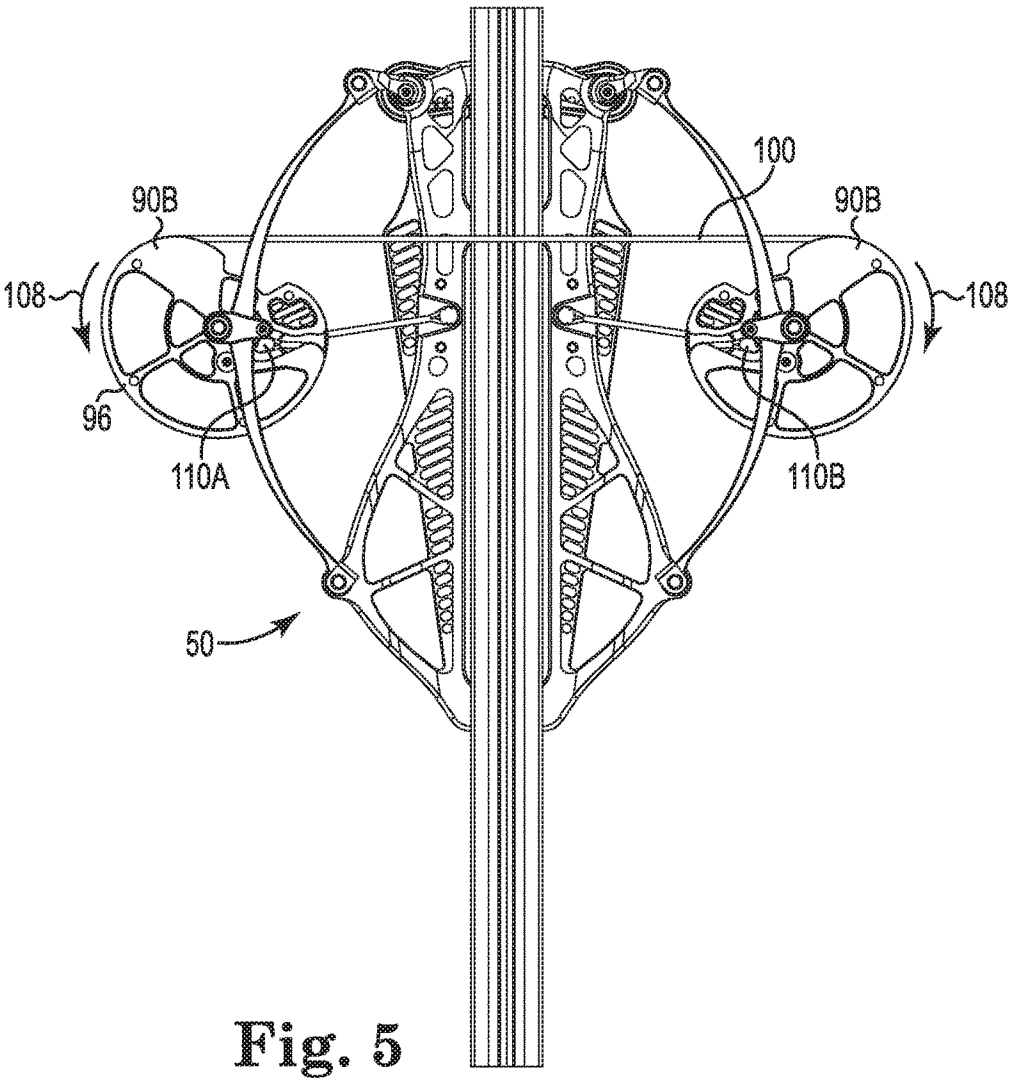
FIG. 5 is a sectional view showing the draw string of the energy storage system of FIG. 1 in a released configuration.

FIG. 5 is a sectional view of the energy storage device 50 showing the path of the draw string 100 on the pulley assemblies 90 in the released configuration 130. The draw string 100 wraps around distal portions of the draw string journals 96 in direction 108 and the ends of the draw string 100 are attached to anchors 110A, 110B on the pulleys 90A, 90B, respectively. In the illustrated embodiment, the draw string 100 crosses over the center support 52 only once.

Figure 6:
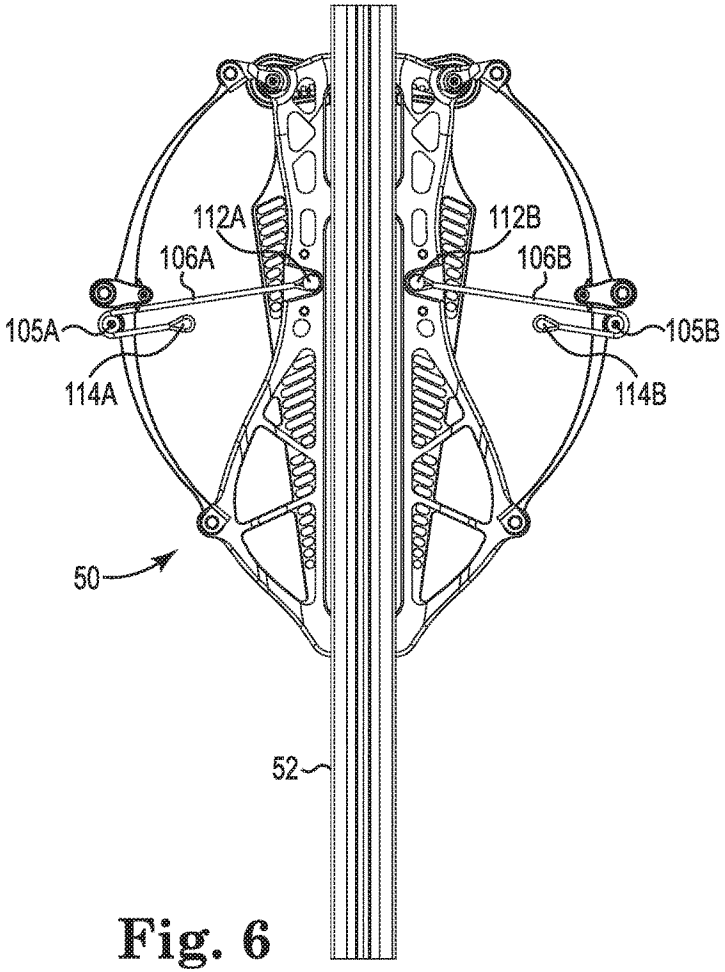
FIG. 6 is a sectional view showing the power strings of the energy storage system of FIG. 1 in the release configuration.

FIG. 6 is a sectional view of the energy storage device 50 showing the path of the power strings 106A, 106B in the release configuration 130. The power strings 106 attach to the center support 52 by anchors 112A, 112B and wrap around distal portions of the power string pulleys 105A, 105B, respectively. The opposite ends of the power strings 106A, 106B are attached to the pulleys 90A, 90B (not shown by anchors 114A, 114B, respectively. In the illustrated embodiment, the power strings 106 do not cross over the center support 52.

The geometric profiles of the draw string journals 96 and the power string journals 104 contribute to let-off at full draw. The configuration of the limbs 64, 66 and the limb relief of the limbs 64, 66 to the center support 52 also contribute to let-off. A more detailed discussion of cams suitable for use in bows is provided in U.S. Pat. No. 7,305,979 (Yehle), which is hereby incorporated by reference.

Figure 7:
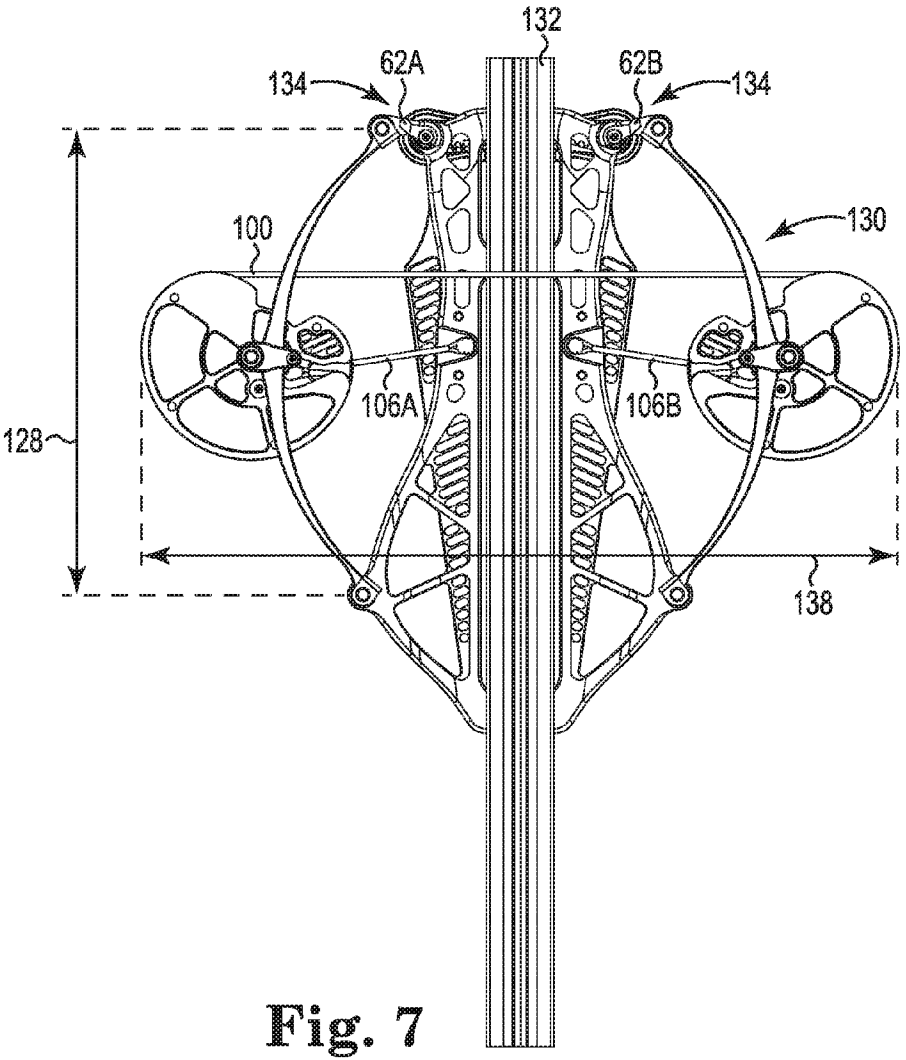
FIG. 7 is a top view of the energy storage system of FIG. 1 in a released configuration in accordance with the embodiment of the present disclosure.

FIG. 7 is a top view of the energy storage device 50 in a released configuration 130 with the draw string 100 in its forward most position relative to the distal end 132 of the center support 52. Static tension between the draw string 100 and the power strings 106 is opposed by slight flexure of the limbs 64, 66 to maintain the translation arms 62 in retracted position 134.

In the retracted position 134 the translation arms 62 are rotated back toward proximal end 136 of the center support, with the limbs 64, 66 in a generally concave configuration with respect to the center support 52. In the release configuration 130 distance 128 between the proximal limb mounts 56 and the translation arm mounts 78 is at a minimum and width 138 of the energy storage device 50 is at its maximum.

FIG. 8 is a top view of the energy storage device 50 with the draw string 100 in a drawn configuration 140. The process of drawing the draw string 100 toward the proximal end 136 of the center support 52 simultaneously causes the pulley assemblies 90 to rotate in directions 142 and the limbs 64, 66 to deform inward toward the center support 52.

In the illustrated embodiment, the limb relief increases the distance 148 between the proximal limb mounts 56 and the translation arm mounts 78 to be greater than the distance 128 (see FIG. 5). In the drawn configuration 140 distance 148 between the proximal limb mounts 56 and the translation aim mounts 78 is at a maximum and width 150 of the energy storage device 50 is at a minimum. The distance 148 in the drawn configuration 140 is greater than the distance 128 in the released configuration 130. The width 150 in the drawn configuration is less than the width 138 in the released configuration 130.

Operation of the illustrated embodiment includes locating an arrow or bolt in groove 162 with knock engaged with the draw string 100 in location 164. Release of the draw string 100 causes the limbs 64, 66 to return to the released configuration 130, thereby launching the bolt in direction 166.

As best illustrated in FIG. 8, the finger guards 53 is configured to extend to at least space 101, which corresponds to the space traversed by the draw string 100 from the drawn configuration 140 to the released configuration 130. The finger guard 53 is configured to reduce the chance of a user's finger extending up from the bottom of the center support 52 and into the path 103 of the draw string 100 from the drawn configuration 140 to the released configuration 130. In the preferred embodiment, the finger guard 53 completely blocks access from the bottom of the center support 52 to the space 101. In another embodiment, gap 105 between the draw string 100 and the finger guards 53 is less than about 0.5 cm.

The energy storage device 50 typically includes a trigger assembly to retain the draw string 100 in the drawn configuration 140 and a stock located near the proximal end 136 of the center support 52. Most trigger assemblies include a dry fire mechanism that prevents release of the draw string 100 unless a bolt is positioned in the center support 52. Suitable trigger assemblies and stocks are disclosed in U.S. Pat. Nos. 8,240,299 (Kronengold et al.); 8,104,461 (Kempf); 8,033,275 (Bendar et al.); 8,020,543 (Maleski et al.); 7,836,871 (Kempf); 7,810,480 (Shepley et al.); 7,770,567 (Yehle); 7,743,760 (Woodland); 7,363,921 (Kempf); 7,328,693 (Kempf); 7,174,884 (Kempf et al.); 6,736,123 (Summers et al.); 6,425,386 (Adkins); 6,205,990 (Adkins); 5,884,614 (Darlington et al.); 5,649,520 (Bednar); 5,598,829 (Bednar); 5,596,976 (Walser); 5,085,200 (Horton et al.); 4,877,008 (Troubridge); 4,693,228 (Simonds et al.); 4,479,480 (Holt); 4,192,281 (King); and 4,030,473 (Puryear), which are hereby incorporated by reference.

Figure 9:
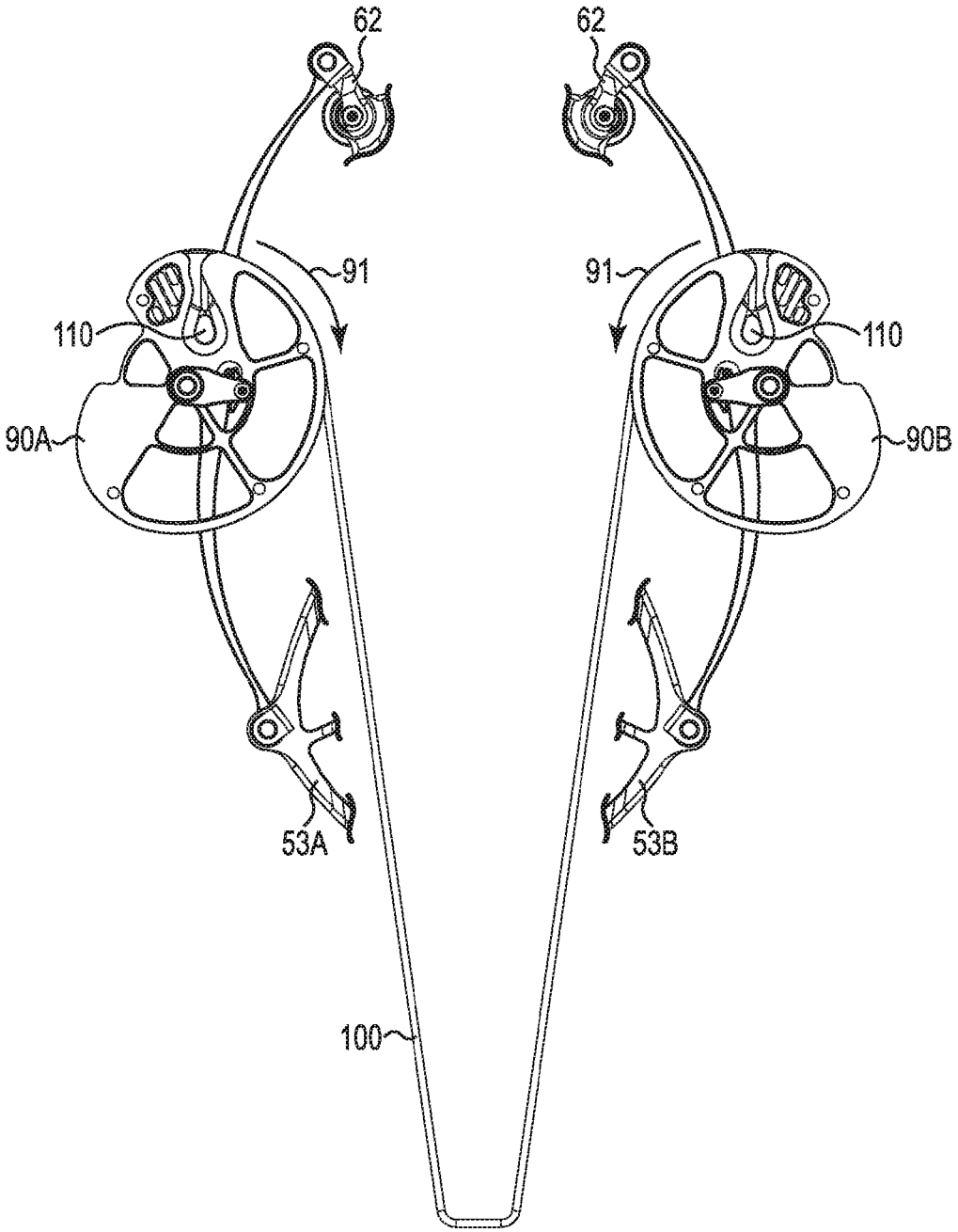
FIG. 9 is a sectional view showing the draw string of the energy storage system of FIG. 1 in a drawn configuration.

FIG. 9 is a sectional view of FIG. 8 with the center support 52 removed to better illustrate the path of the draw string 100 in the drawn configuration 140. The pulley assemblies 90 are rotated in direction 91 until the draw string is fully drawn.

Figure 10:
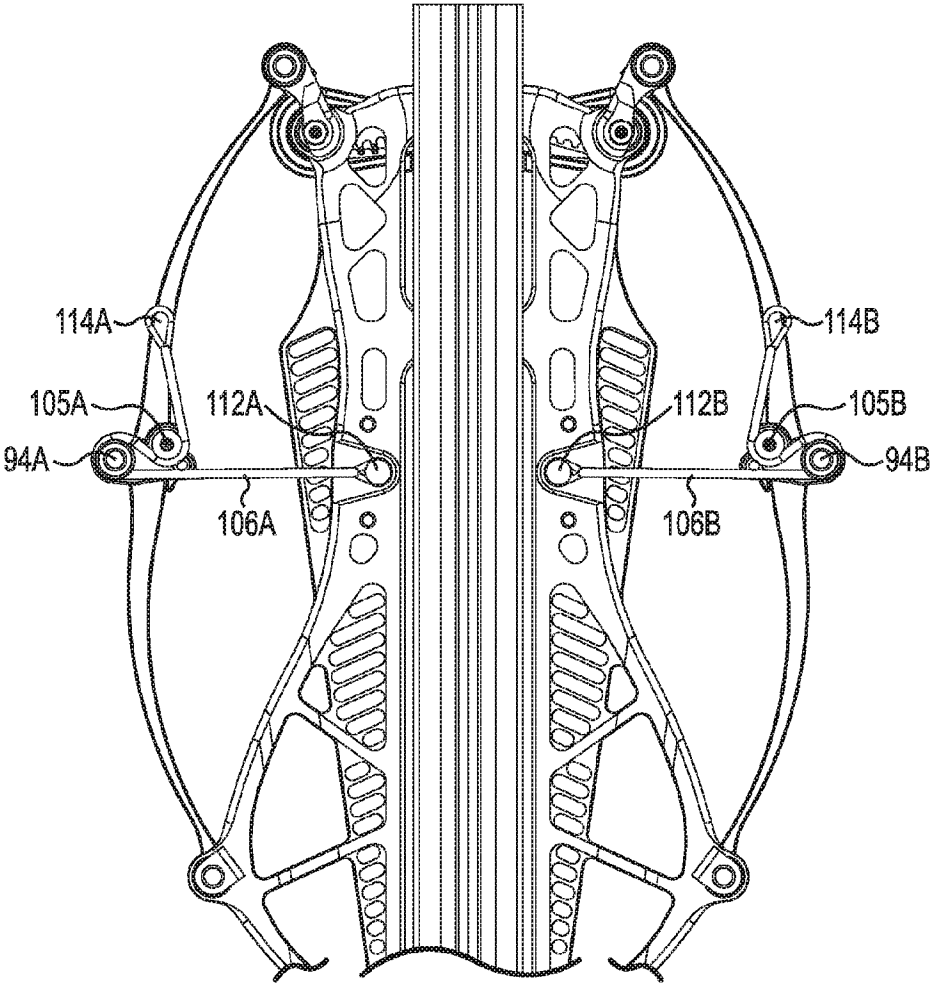
FIG. 10 is a sectional view showing the power strings of the energy storage system of FIG. 1 in the drawn configuration.

FIG. 10 is a sectional view of FIG. 8 with the draw string pulleys removed to illustrate the path of the power strings 106 in the drawn configuration 140. The power strings 106 wrap around the power pulleys 105 in a first direction and around the pivot axes 94 of the pulley assemblies 90 in the opposite direction, terminating at anchors 112, as discussed above.

Figure 11:
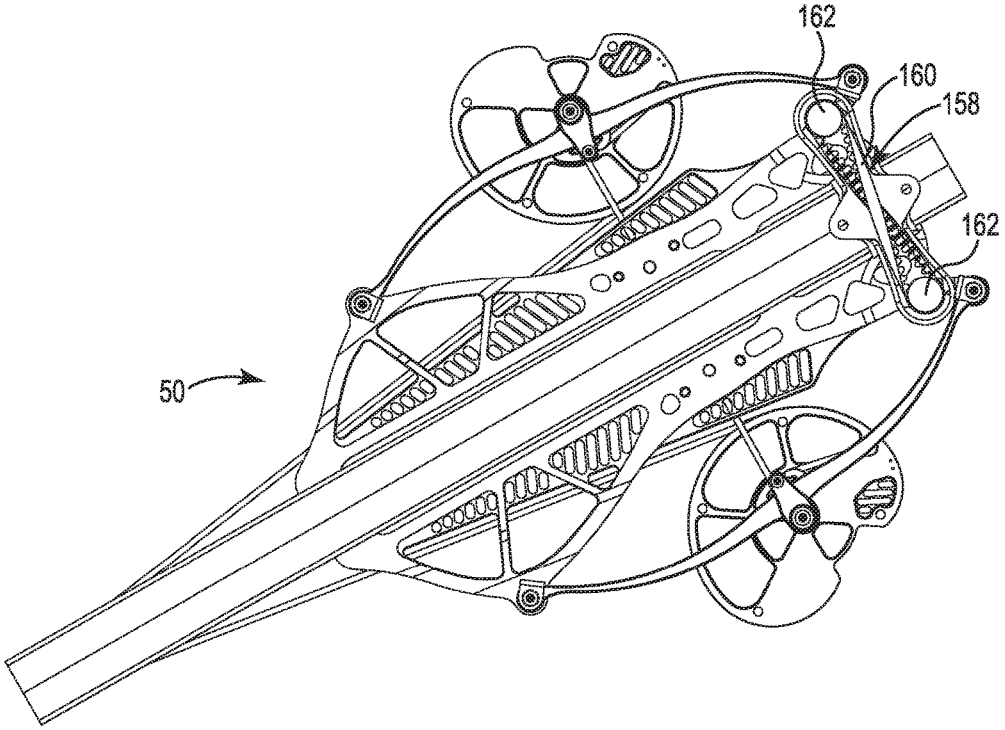
FIG. 11 is a bottom view of the energy storage system of FIG. 1 showing a timing belt in accordance with an embodiment of the present disclosure.

FIG. 11 is a bottom sectional view of the energy storage device 50 with synchronization assembly 158 exposed. In the illustrated embodiment, the synchronization assembly 158 includes, timing belt 160 wrapped around pulleys 162 that are coupled to; the rotation of the translation arms 62. The timing belt 160 synchronizes the rotation of the translation arms 62 (see FIG. 6A) between the retracted position 134 and the extended position 146. In the illustrated embodiment, the timing belt 160 is a toothed belt twisted into a figure eight configuration. Alternate synchronization assemblies can include gears, belts, cables, chains, linkages, and the like.

Figure 12A:
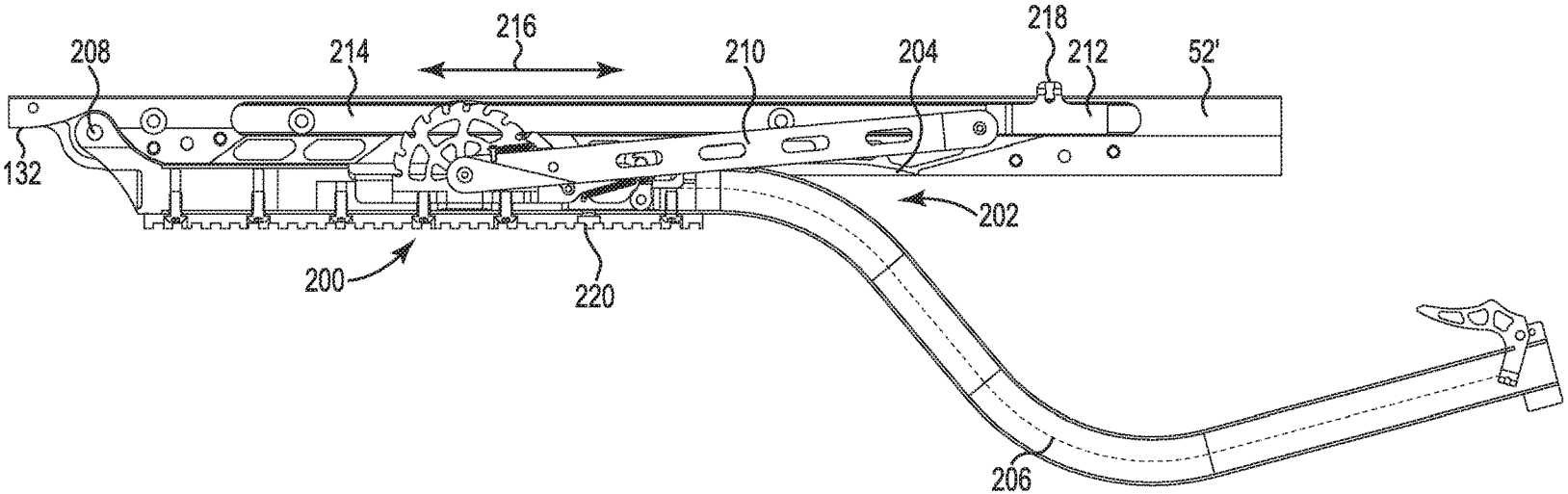
FIG. 12A is a sectional view of a center support with a cocking system in accordance with an embodiment of the present disclosure.
Figure 12B:
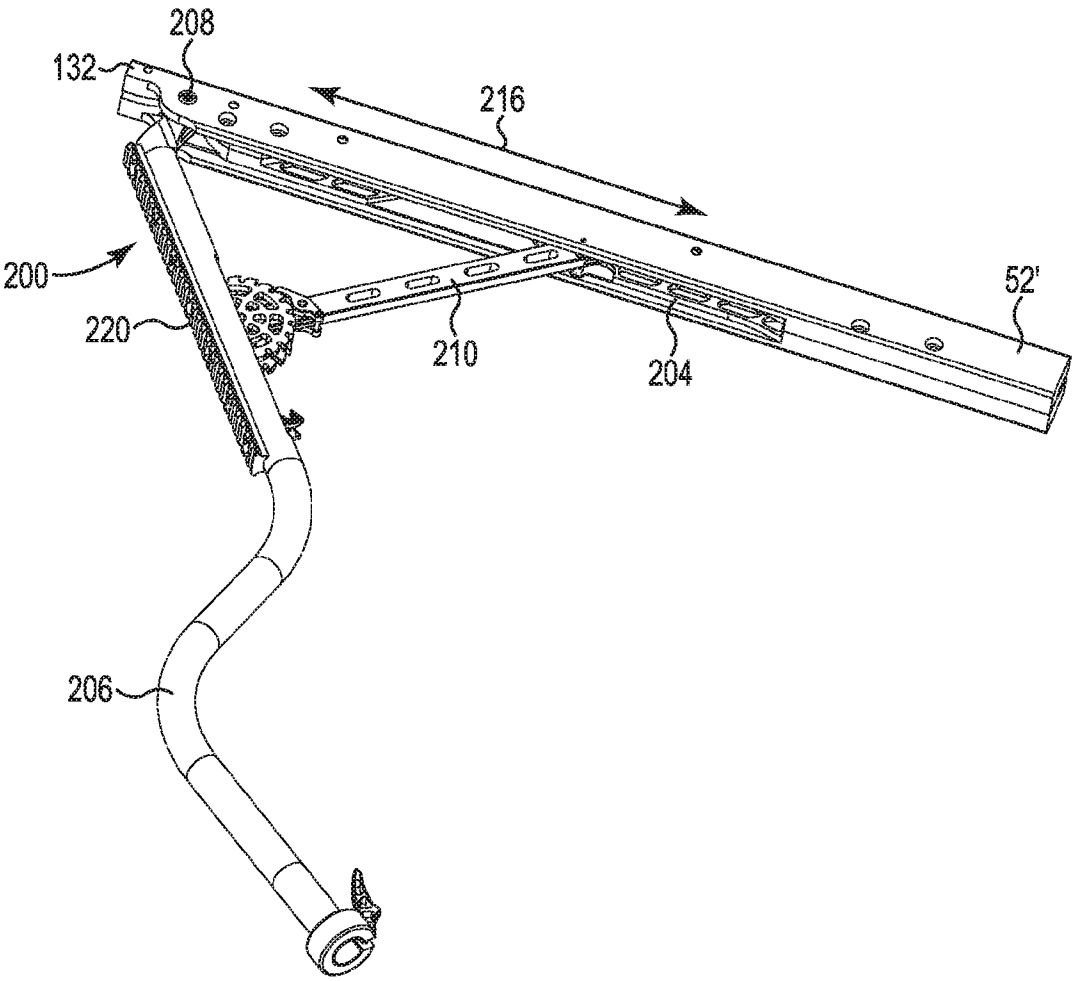
FIG. 12B is perspective view of the center support of FIG. 12A.

FIG. 12A is a sectional view of an alternate center support 52' modified to include cocking mechanism 200 shown in a closed and locked configuration 202 in accordance with an embodiment of the present disclosure. FIG. 12B is a perspective view of the center support 52' with the cocking mechanism 200 in a partially opened configuration.

The center support 52' is machined to create opening 204 that receives the cocking mechanism 200. The cocking mechanism 200 includes an elongated tube 206 pivotally attached to the center support 52' at location 208 near the distal end 132. Arm 210 pivotally couples the elongated tube 206 to traveler 212 that slides back and forth along axis 216 in channel 214 formed in the center support 52'. The traveler 212 includes finger 218 that captures the draw string 100 to move it from the released configuration 130 to the drawn configuration 140 and into engagement with a trigger assembly (not shown). In the illustrated embodiment, the elongated tube 206 includes a conventional accessory rail 220, used to attach various accessories to the center support 52', such as forward grips, laser sights, and the like.

Figure 13:
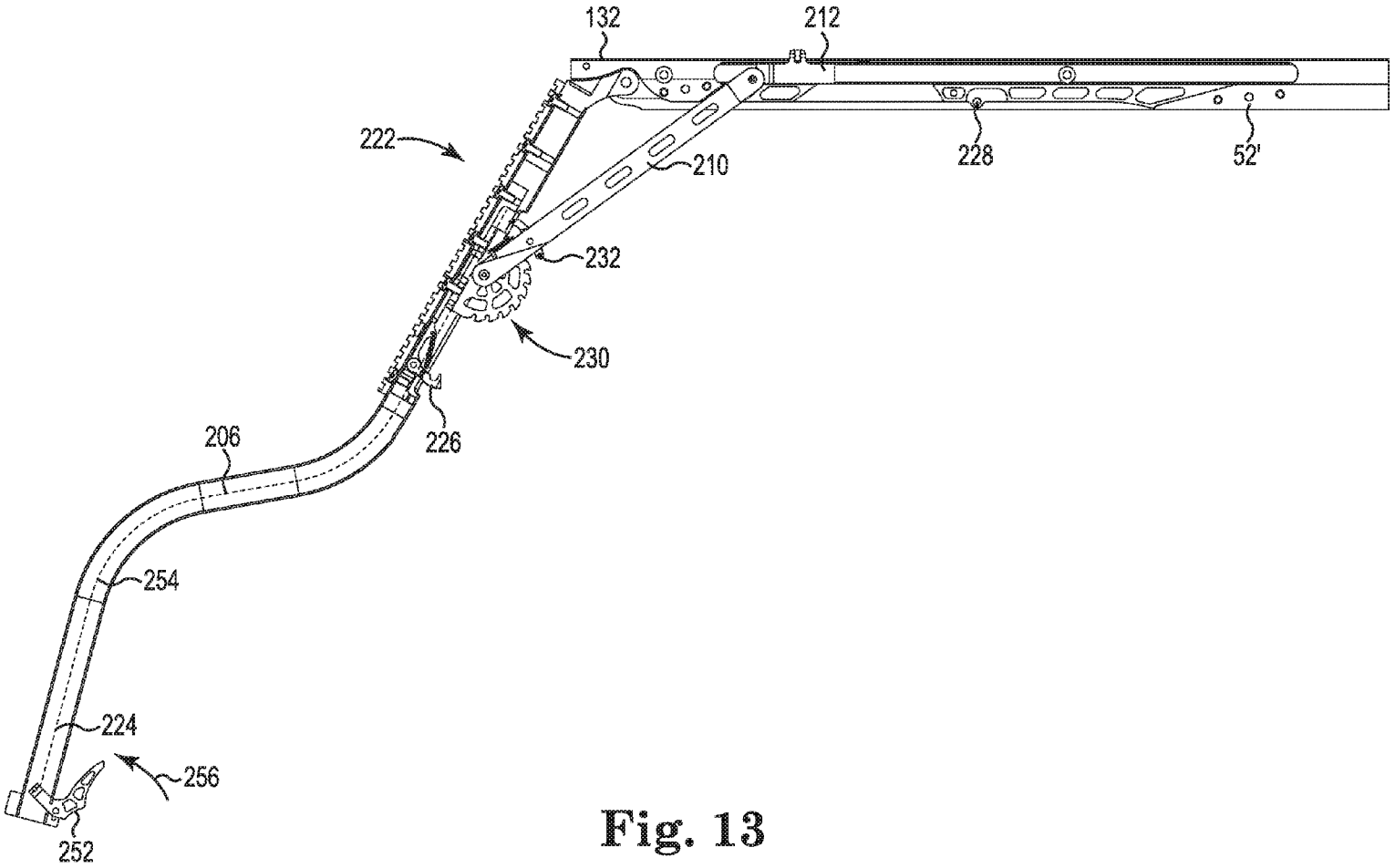
FIG. 13 is a sectional view of the cocking mechanism of FIG. 12A in a fully open configuration in accordance with an embodiment of the present disclosure.

FIG. 13 is a sectional view of the center support 52' in a fully open configuration 222. The arm 210 advances the traveler 212 to the distal end 132 of the center support 52' to capture the draw string 100. In order to cock the energy storage device 50, the user grasps proximal end 224 of the elongated tube 206 and returns it to the closed and locked configuration 202. Latch 226 engaged with pin 228 on the center support 52' to lock the cocking mechanism 200 in the closed and locked configuration 202.

The limbs 64, 66 resist movement of the elongated tube 206 back to the closed and locked configuration 202. If the user inadvertently releases the elongated tube 206 during this process, it will snap back to the fully open configuration 222 with considerable force. Ratcheting mechanism 230 prevents this outcome.

Figure 14:
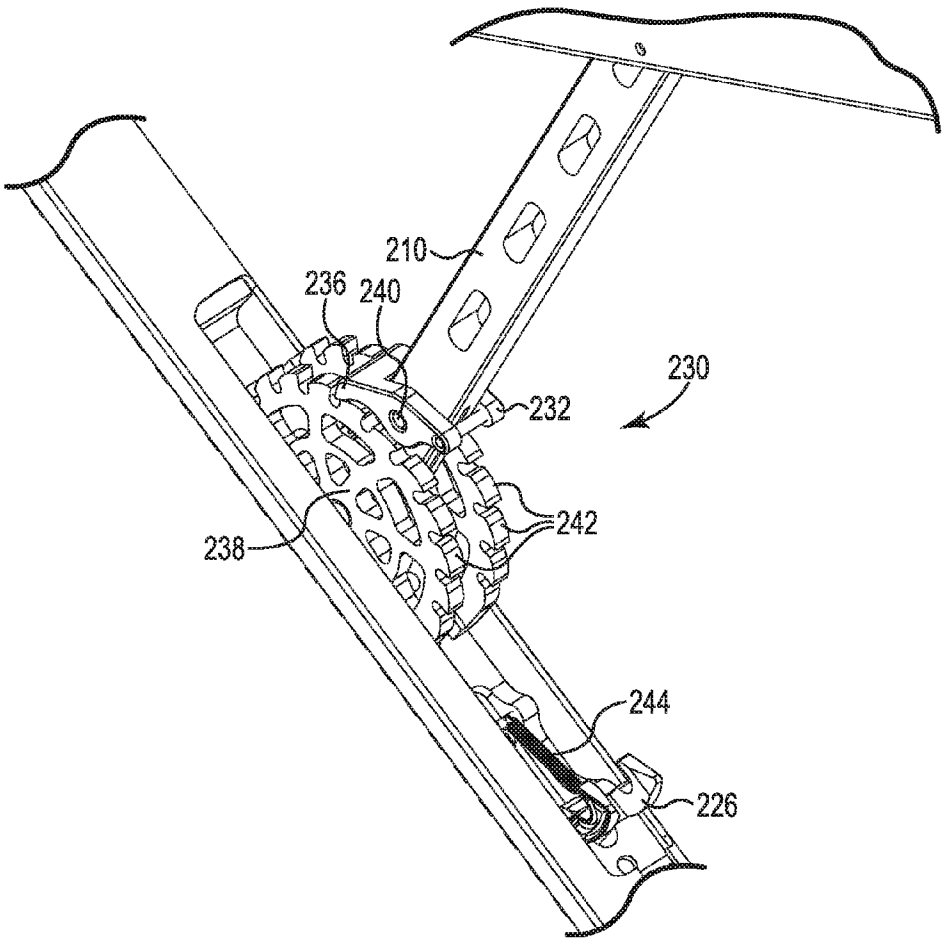
FIG. 14 is a perspective view of a ratcheting mechanism for a cocking mechanism in accordance with an embodiment of the present disclosure.
Figure 15:
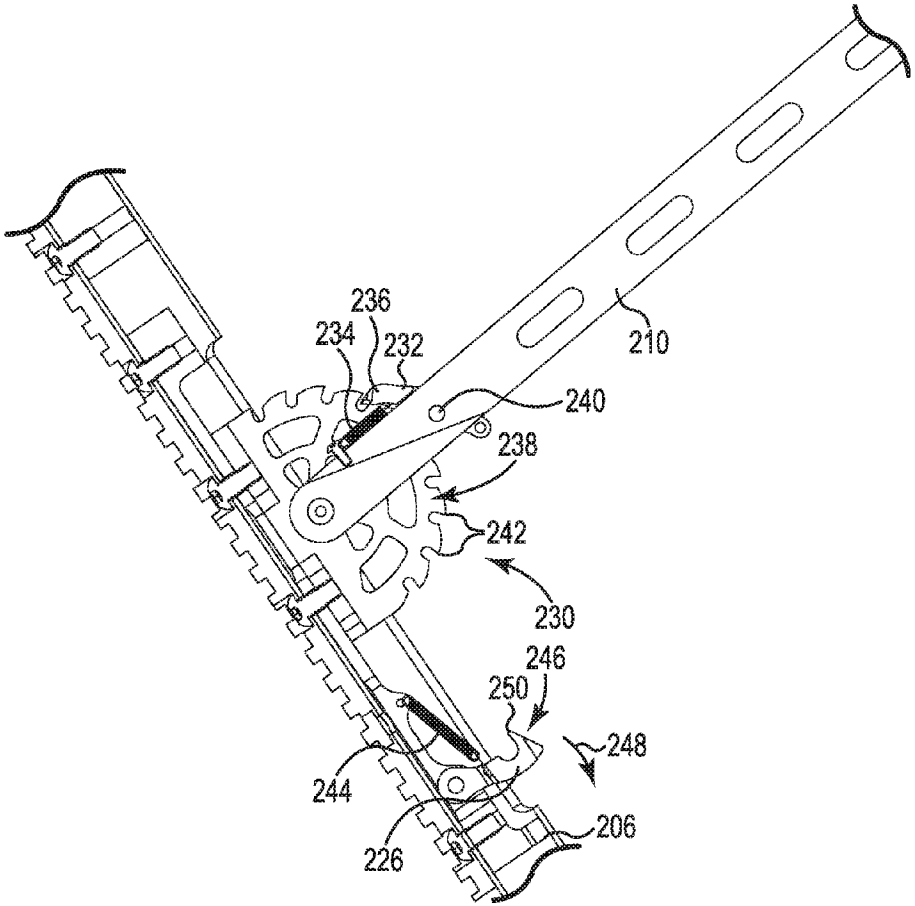
FIG. 15 is a sectional view of the ratcheting mechanism of FIG. 14.

As best illustrated in FIGS. 14 and 15, the ratcheting mechanism 230 includes pawl 232 pivotally attached to the arm 210. Spring 234 biases distal end 236 of the pawl 232 into engagement with tooth members 238 that are mounted to the elongated tube 206. As the elongated tube 206 is moved to the closed and located configuration 202, the pawl 232 rocks up and down around pivot 240 to sequentially engage with teeth 242. As a result, inadvertent release of the elongated tube 206 does not result in the cocking mechanism 200 returning to the fully open configuration 222.

Also illustrated in FIGS. 14 and 15 is additional detail for the latch 226. Spring 244 biases the latch 226 in a locked configuration 246. As the elongated tube 206 is pushed to the closed and locked configuration 222, the latch 226 is pushed by the pin 228 in direction 248 until the pin 228 clears tip 250, at which point the latch 226 returns to the locked configuration 246.

As illustrated in FIG. 13, operation of the pawl 232 and the latch 226 is simultaneously controlled by thumb trigger 252 located near proximal end 224 of the elongated tube 206. In the illustrated embodiment, cable 254 is attached to the thumb trigger 252 and both of the pawl 232 and the latch 226. Depressing the thumb trigger 252 in direction 256 disengages the pawl 232 from the teeth 242 and the latch 226 from the pin 228, respectively. Various alternate cocking mechanisms can be used to pull the draw string 100 to the drawing configuration 130, such as disclosed in U.S. Pat. Nos. 7,624,725 (Choma); 7,204,242 (Dziekan); 6,913,007 (Bednar); 4,942,861 (Bozek); 6,799,566 (Malucelli); 6,705,304 (Pauluhn); 6,286,496 (Bednar); 6,095,128 (Bednar); and 4,719,897 (Gaudreau), which are hereby incorporated by reference.

Figure 16:
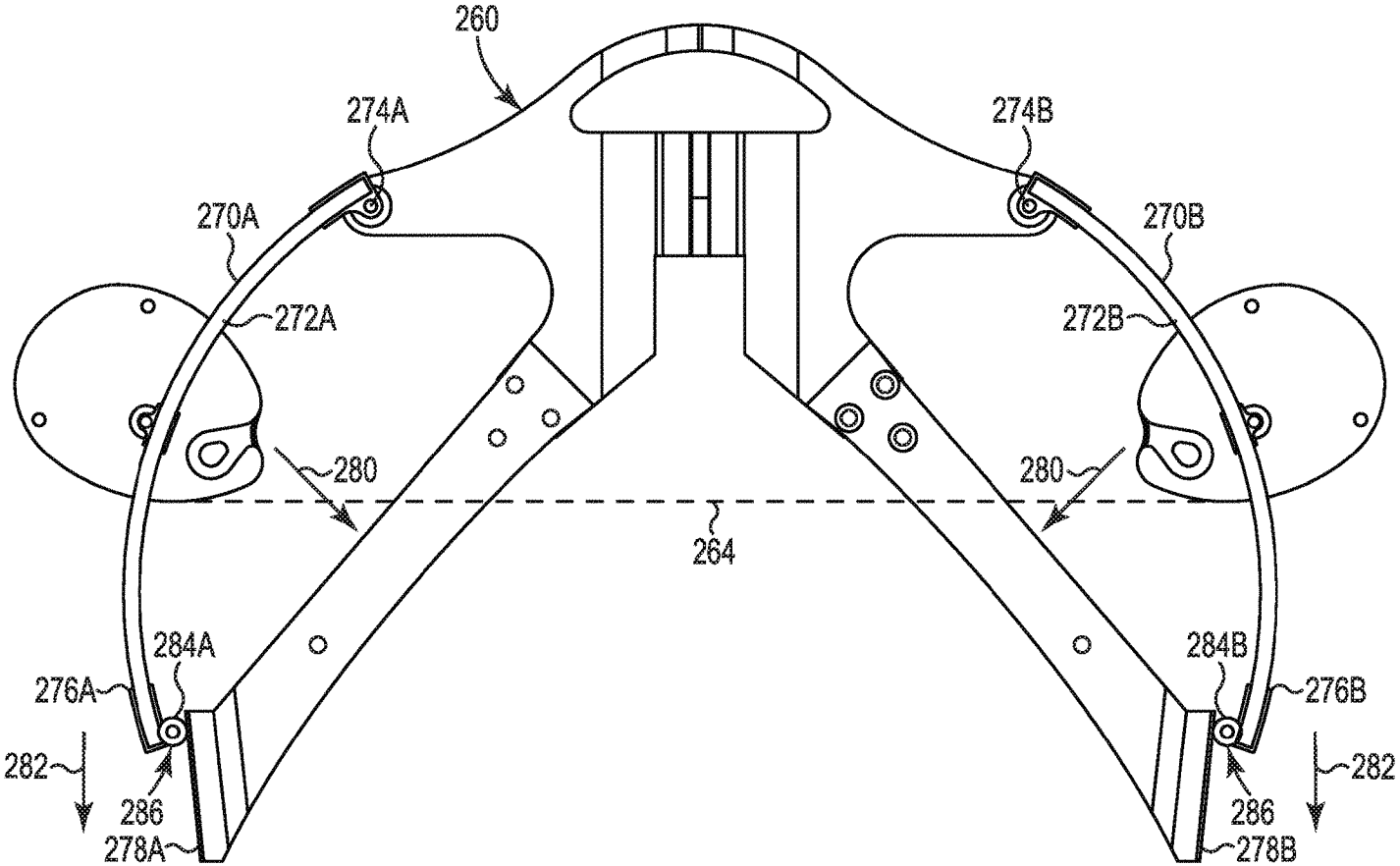
FIG. 16 is a plan view of an alternate energy storage device for an energy storage system in accordance with an embodiment of the present disclosure.

FIG. 16 illustrates an alternate energy storage device 260 with alternate limb relief in accordance with an embodiment of the present disclosure. The center support 262, the draw string 264, and the power stings 266A, 266B are removed for clarity (see FIG. 17).

Distal portions 270A, 270B ("270") of limbs 272A, 272B ("272") are attached to the device 260 at locations 274A, 274B (274"), respectively. The attachment at the locations 274 can employ various couplings (e.g., a rigid coupling, a pivoting coupling, a linkage coupling, a rotating coupling, a sliding coupling, an elastomeric coupling, or a combination thereof). Proximal portions 276A, 276B ("276") of the limbs 272 are configured to engage with portions 278A, 278B ("278") of the device 260, respectively. It is possible to reverse this configuration by locating the portions 278 at the distal end of the device 260.

When the draw string 264 is in the drawn configuration 140, the limbs 272 deform in direction 280 and the proximal portions 276 translate along portions 278 in direction 282 to provide limb relief through a sliding coupling. In one embodiment, the portions 278 have a curvilinear shape to increase let-off when the draw string 264 is in the fully drawn configuration 140.

In another embodiment, the proximal portions 276 are dynamically coupled to the portions 278 of the device 260. The proximal portions 278 are not attached to the device 260. For example, space 286 may exist between the proximal portions 276 of the limbs 272 and the portions 278 when the draw string 264 is in the released configuration 130. As the limbs 272 deformed while the draw string 264 is drawn, however, the proximal portions 276 of the limbs 272 engage with the portions 278 on the device 260 and are displaced in the direction 282, in a combination of a dynamic coupling and a sliding coupling.

In another embodiment, the proximal portions 276 are positively coupled to the portions 278 by sliding couplings 284A, 284B ("284"). One advantage of the positive couplings 284 is that when the draw string 264 is released, the proximal portions 276 are prevented from lifting off of the portions 278 on the device 260, reducing noise.

In another embodiment, the proximal portions 276 of the limbs 272 are fixedly attached to the portions 278 of the device 260 as shown. The portions 278 are constructed from an elastomeric material configured to deform as the limbs 272 are deformed in the direction 280 to provide limb relief via an elastomeric coupling.

Any of the limb relief embodiments disclosed herein may be used alone or in combination.

Figure 17:
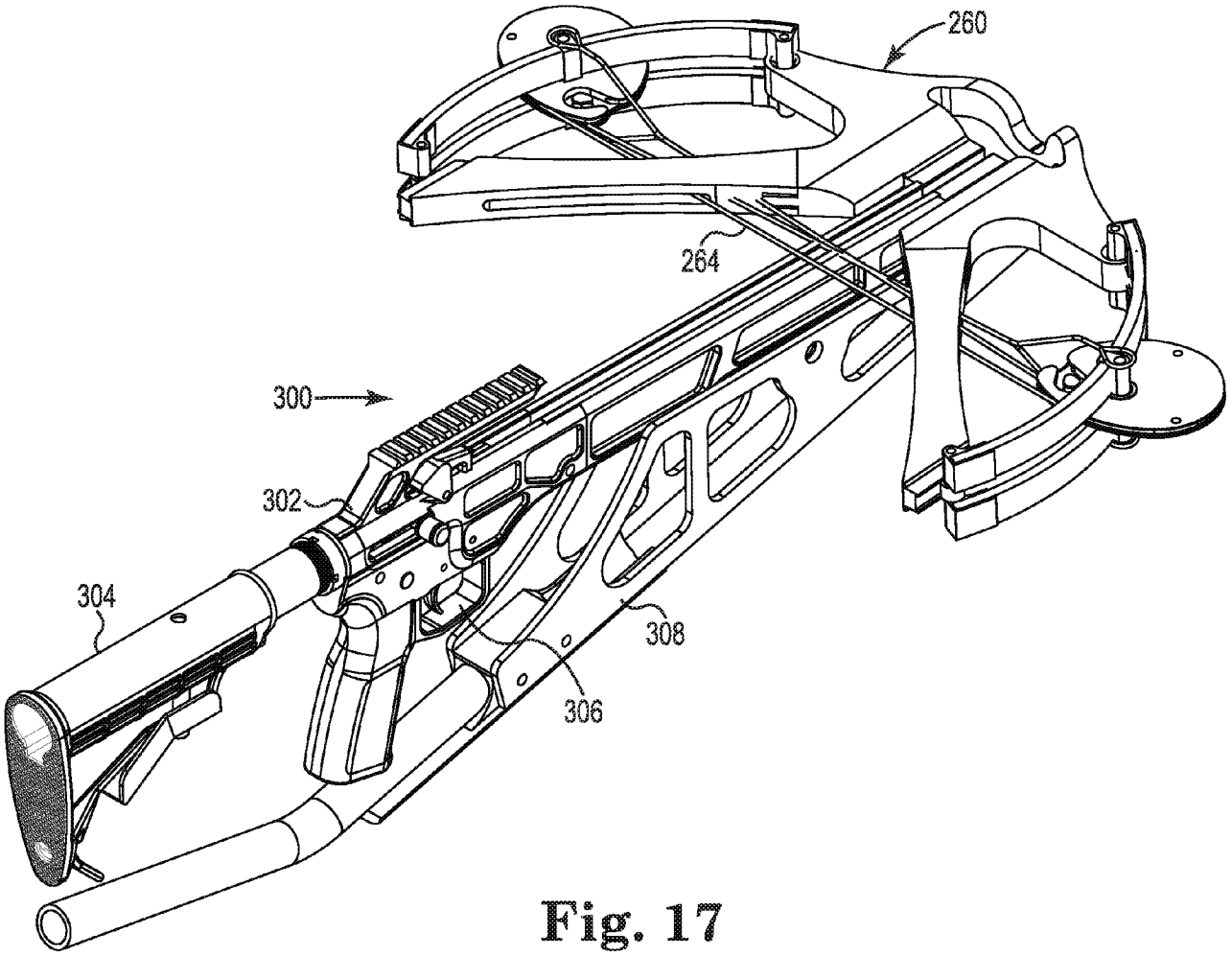
FIG. 17 is a bow with the energy storage device of FIG. 16 in accordance with an embodiment of the present disclosure.

FIG. 17 is a perspective view of bow 300 with the energy storage device 260 in accordance with an embodiment of the present disclosure. Proximal end 302 of the center support 262 includes stock 304 and trigger assembly 306 configured to releasably retain draw string 264 in the drawing configuration 140. Cocking assembly 308 is mounted at bottom of center support 262 as discussed herein.

Figure 18:
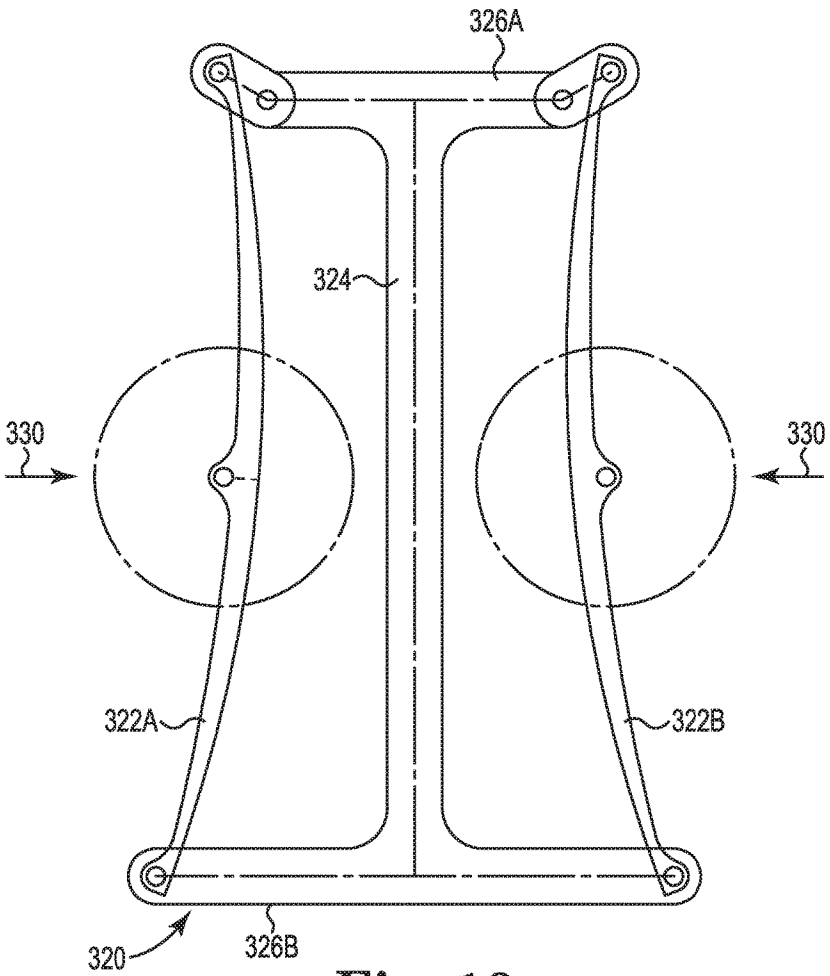
FIG. 18 illustrates an energy storage portion for a bow with convex limbs in accordance with an embodiment of the present disclosure.

FIG. 18 is a schematic illustration of an alternate energy storage device 320 with convex limbs 322A, 322B ("322") with respect to center support 324 in accordance with an embodiment of the present disclosure. The center support 324 includes distal and proximal spacers 326A, 326B ("326") that retain the limbs 322 in a spaced configuration.

The convex limbs 322 deflect inward in directions 330 toward the center support 324 as the draw string (not shown) is moved to the drawing configuration. In the illustrated embodiment, limb relief is provided by translation arms 328, although any of the limb relief mechanism disclosed herein may be used.

FIGS. 19A and 19B illustrate an alternate energy storage device 350 in which limb relief is provided by center support 352 in accordance with an embodiment of the present disclosure. Center support 352 includes a distal portion 354A and a proximal portion 354B connected by displacement mechanism 356. The displacement mechanism 356 permits the distal portion 354 to be displaced relative to the proximal portion 354B along axis 358. The displacement mechanism 356 may be an elastomeric member, a pneumatic or hydraulic cylinder, or a variety of other structures configured to bias the distal portion 354A toward the proximal portion 354B along the axis 358.

Distal ends 360A, 360B ("360") of limbs 362A, 362B ("362") are attached to the distal portion 354A of the center support 352. Proximal ends 364A, 364B ("364") of limbs 362 are attached to the proximal portion 354B of the center support 352. As the draw string (not shown) is moved to the drawing configuration 140, the limbs 362 flatten so that distance 366 between distal ends 360 and proximal ends 364 of the limbs 362 increases to provide limb relief. As the draw string is released, the displacement mechanism 356 biases the distal portion 354A toward the proximal portion 354B to the configuration shown in FIG. 19A.

Figure 20A:
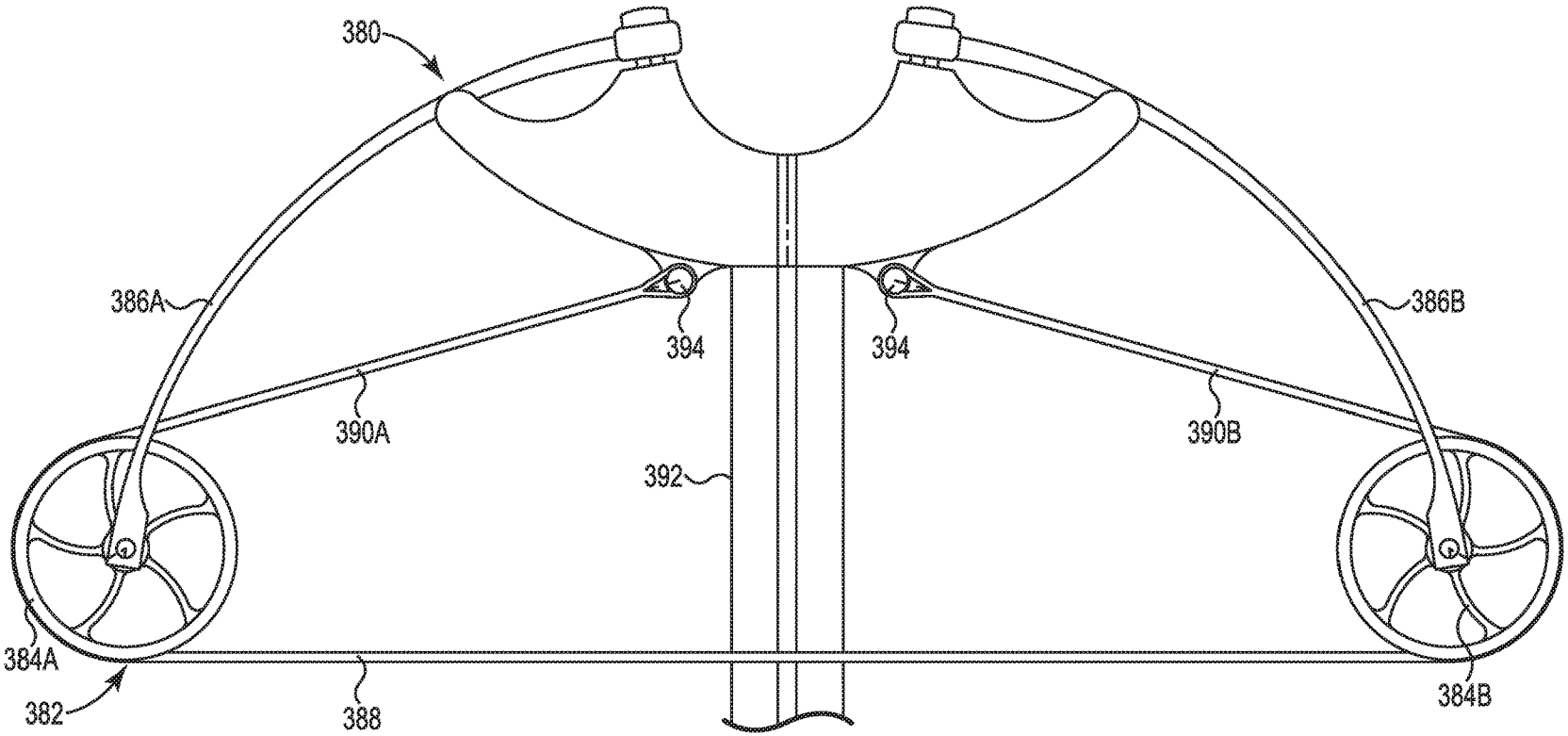
FIGS. 20A and 20B illustrate a conventional energy storage portion of a conventional bow with a pulley system in accordance with an embodiment of the present disclosure.
Figure 20B:
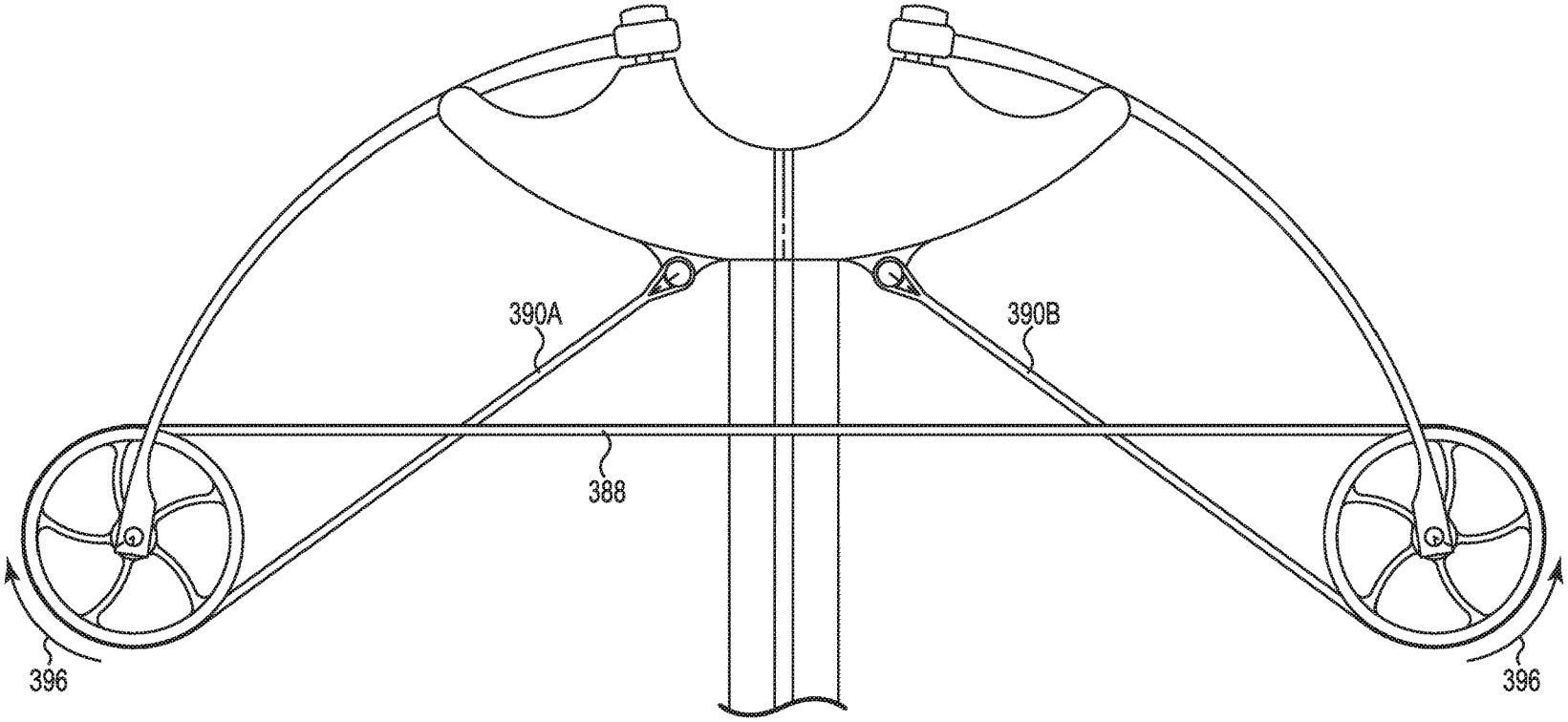

FIGS. 20A and 20B are top views of an energy storage portion 380 of a conventional bow with a pulley system 382 in accordance with an embodiment of the present disclosure. The pulley system 382 includes pulleys 384A, 384B ("384") attached to ends of limbs 386A, 386B ("386"). Draw string 388 and power strings 390A, 390B ("390") wrap around the pulleys 384 and attach to the center support 392. The power strings 390 do not cross-over the center support 388. Consequently, only the draw string 384 crosses over the center support 388.

In the illustrated embodiment, the power strings 390 and the draw string 388 are a single structure with ends 394 attached to the center support 392. In an alternate embodiment, the power strings 390 and the draw strings 388 can be discrete structures, such as illustrated in FIG. 3. The embodiment of FIG. 20B reverses the wrap of the power strings 390 and draw string 388 around the pulleys 384 in directions 396 to increase the draw length.

Figure 21C:
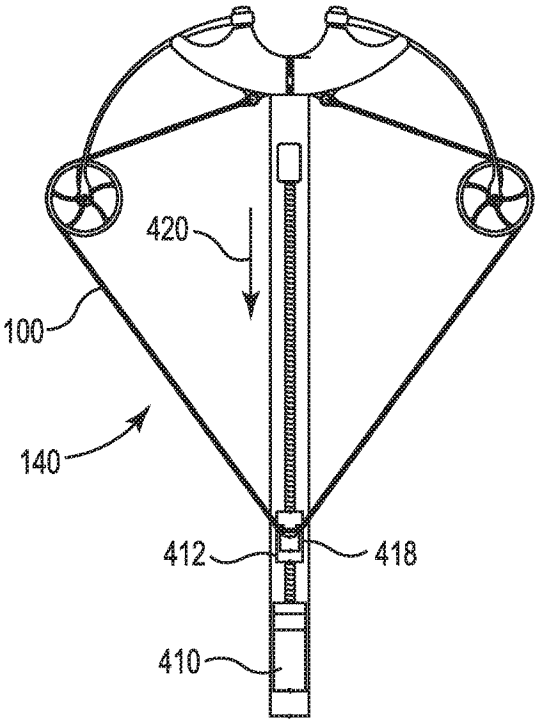
FIGS. 21A-21C illustrate an alternate cocking mechanism for a bow in accordance with an embodiment of the present disclosure.
Figure 21B:
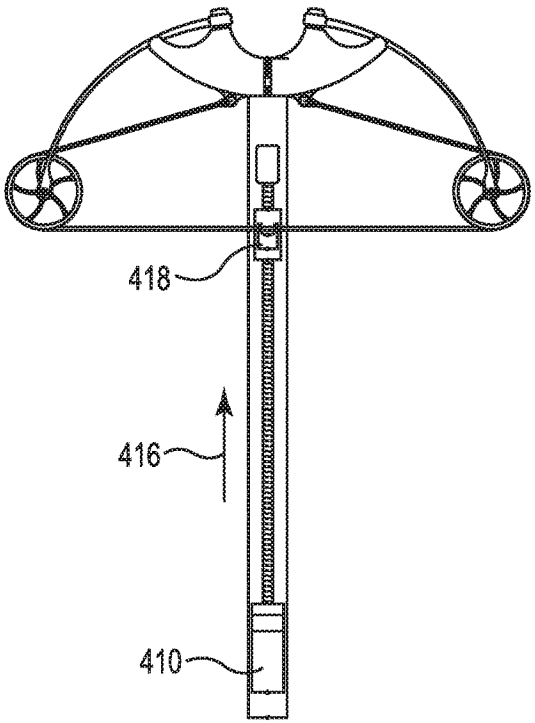
Figure 21A:
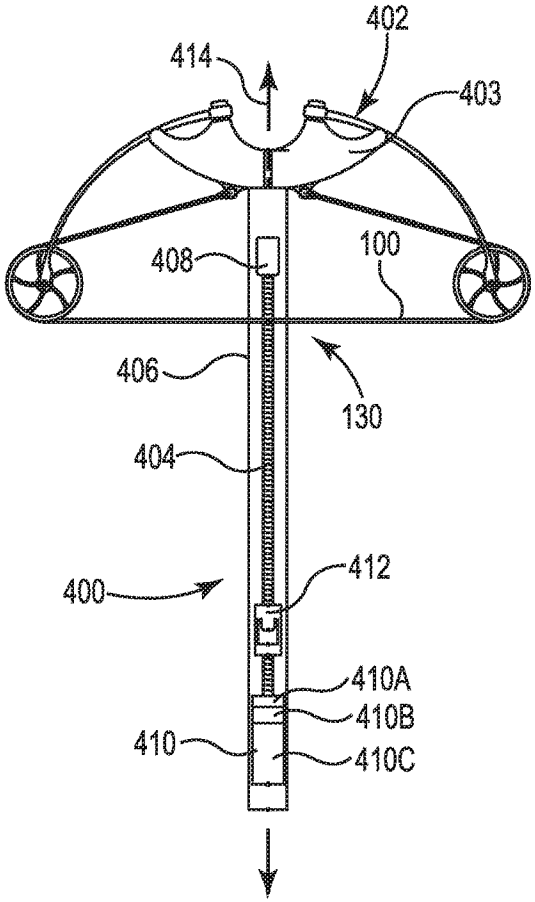

FIGS. 21A-21C illustrate an alternate cocking mechanism 400 for a bow 402 in accordance with an embodiment of the present disclosure. The present cocking mechanism 400 can be used with any of the bows disclosed herein. The cocking mechanism is preferably located in a recess in the center support 406 (see e.g., FIG. 22) for optimum weight distribution.

Threaded shaft 404 is mounted in or on center support 406 between distal pivot assembly 408 and proximal pivot assembly 410 behind or proximal of the energy storage assembly 403 of the bow 402. The threaded shaft 404 can be a ball screw, lead screw, power screw, translation screw, or the like. The threaded shaft 404 can be constructed from a variety of materials, such as light weight metals like aluminum or polymeric materials such as nylon or high density polyethylene. The threaded shaft 404 can have a thread pitch in the range of about 0.25 inches to about 2.0 inches.

Traveler 412 traverses axis 414 as the threaded shaft 404 is rotated. Rotation of the threaded shaft 404 can be effectuated from either the distal or proximal pivot assemblies 408, 410. In the illustrated embodiment, the proximal pivot assembly 410 includes a mechanism for rotating the threaded shaft 404, such as a rotary crank, a lever, or an electromagnetic device, such as a motor. In one embodiment, the proximal pivot assembly 410 includes pivot bearing 410A, a motor 410B, and a battery 410C. The motor 410B and/or battery 410C can either be part of the proximal pivot assembly 410 or separate component.

In one another embodiment, the motor 410B and battery 410C releasably engages with the proximal pivot assembly 410 to operate the threaded shaft 404. When not required, the motor and battery are removed from the bow 402 to reduce weight. In another embodiment, the user carries the battery 410C separate from the bow 402. The battery 410C can be plugged into the proximal pivot assembly 410 to power the motor 410B as needed.

FIG. 21A illustrates the draw string 100 in the release configuration 130. In operation, the threaded shaft 404 is rotated to advance the traveler 412 in direction 416 until drawstring catch 418 engages the draw string 100, as illustrated in FIG. 21B. The drawstring catch 418 preferably slides in a slot formed in the center support 406 (see e.g., FIGS. 12A).

Rotation of the threaded shaft 404 is then reversed to move the traveler 412 in the opposite direction 420 until the draw string 100 is in the drawn configuration 140, as illustrated in FIG. 21C. This process can also be reverse to un-draw the draw string 100 from the drawn configuration 140 to the released configuration 130.

In one embodiment, the traveler 412 brings the draw string 100 into engagement with a trigger assembly (see e.g., FIG. 17). The drawstring catch 418 then releases the draw string 100, which is held in place by the trigger assembly. In another embodiment, the drawstring catch 418 operates as the trigger assembly. Alternate cocking mechanisms for a bow are shown in U.S. Pat. Nos. 7,784,453 (Yehle); 6,913,007 (Bednar); 6,799,566 (Malucelli); and 5,220,906 (Choma), which are hereby incorporated by reference.

In one embodiment, a brake system is provided to control rotation of the threaded shaft 404, such as a friction brake or an eddy current brake. The brake system prevents the traveler 412 from being moved in the direction 416 by the force of the draw string 100.

In another embodiment, a ratcheting system or one-way bearing is used to control movement of the traveler 412 along the length of the center support 406. (see e.g., FIGS. 14 and 15). For example, if the battery lacks sufficient power to move the traveler 412 to the fully drawing configuration, the ratcheting system or one-way bearing prevents the draw string 100 from rapidly returning to the released configuration 130.

Figure 22:
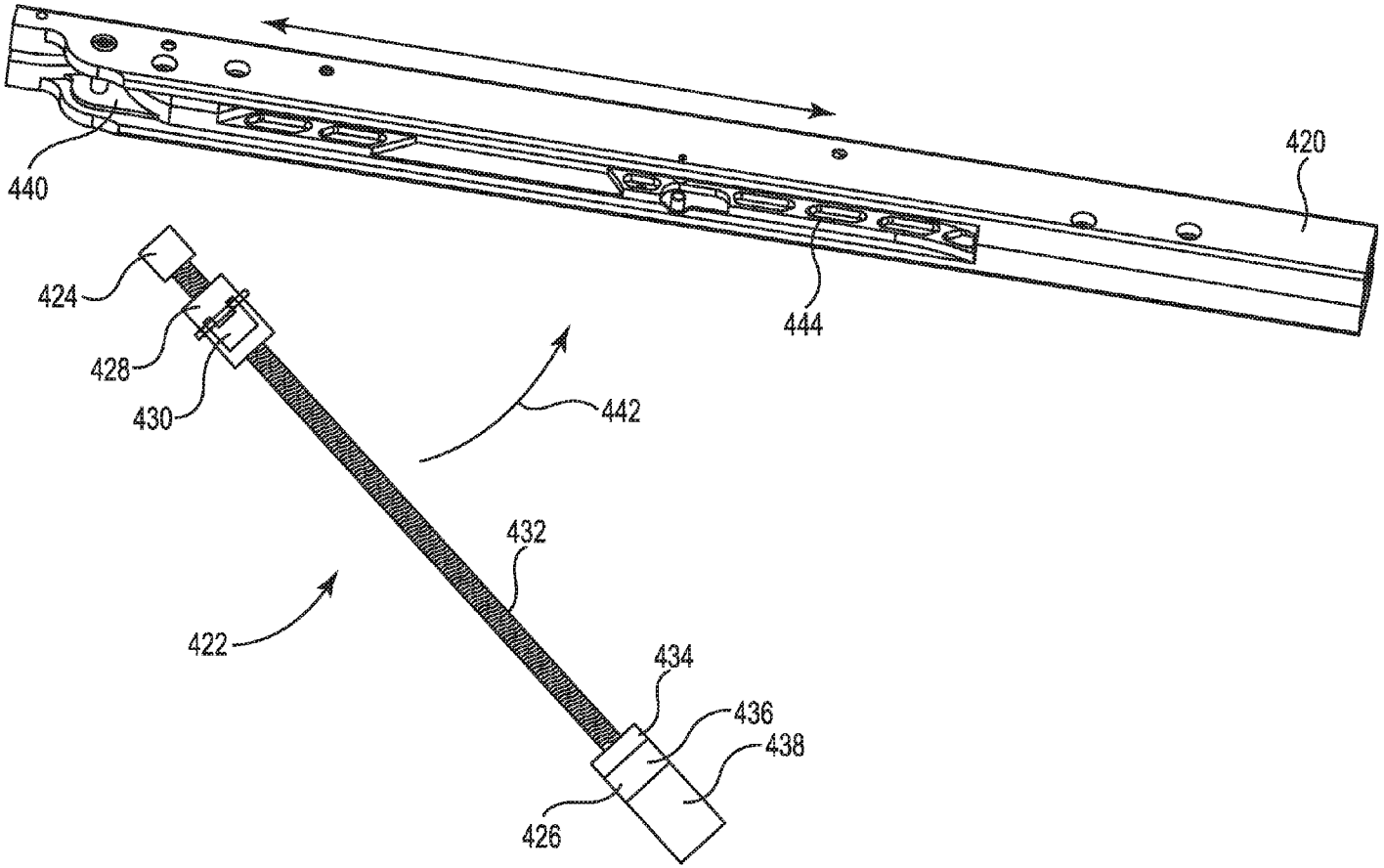
FIG. 22 is a perspective view of a removable cocking mechanism for a bow in accordance with an embodiment of the present disclosure.

FIG. 22 is a perspective view of a center support 420 for a bow (see e.g., FIG. 21A) with a removable cocking mechanism 422 in accordance with an embodiment of the present disclosure. The cocking mechanism 422 includes a distal pivot assembly 424, a proximal pivot assembly 426, and a traveler 428 with a drawstring catch 430 that travels on threaded shaft 432, as discussed above. The proximal pivot assembly 426 includes a pivot bearing 434, a motor 436, and a battery 438.

In one embodiment, the distal pivot assembly 424 is inserted in proximal end 440 of the center support 420. The cocking mechanism 422 is then rotated in direction 442 into engagement with opening 444 in the center support 420. After the drawstring 100 is moved to the drawing configuration 140 (see FIG. 21C), the cocking mechanism 422 can be removed. In another embodiment, the proximal pivot assembly 426 is inserted into the center support 420 first.

FIGS. 23A-23F illustrate an alternate cocking mechanism 450 for a bow 452 in accordance with an embodiment of the present disclosure. The present cocking mechanism 450 can be used with any of the bows disclosed herein. The cocking mechanism is preferably located in a recess in the center support 456 (see e.g., FIG. 22) for optimum weight distribution.

Belt 454 is mounted in or on center support 456 between distal pulley assembly 458 with pulley 458A and proximal pulley assembly 460 with pulley 460A behind or proximal of the energy storage assembly 453 of the bow 452. The belt 454 can be a tooth or smooth belt, a chain, or the like. The belt 454 can be constructed from a variety of materials, such as light weight metals like aluminum or polymeric materials such as nylon or high density polyethylene. The teeth on the belt 454 can have a pitch in the range of about 0.25 inches to about 2.0 inches. In one embodiment, the drive pulley 458A, 460A includes corresponding teeth.

Traveler 462 traverses axis 464 as the belt 454 is rotated around the pulleys 458A, 460A. Rotation of the belt 454 can be of from either the distal or proximal pulley 458A, 460A. In the illustrated embodiment, the proximal pulley assembly 460 includes a mechanism for rotating the pulley 460A, such as a rotary crank, a lever, or an electromagnetic device, such as a motor. In one embodiment, the proximal pulley assembly 460 includes a motor 460B and a battery 460C. The motor 460B and/or battery 460C can either be part of the proximal pulley assembly 460 or separate component.

In one another embodiment, the motor 460B and battery 460C releasably engages with the proximal pulley assembly 460 to operate the pulley 460A. When not required, the motor and battery are removed from the bow 452 to reduce weight. In another embodiment, the user carries the battery 460C separate from the bow 452. The battery 460C can be plugged into the proximal pivot assembly 460 to power the motor 460B as needed.

Figure 23C:
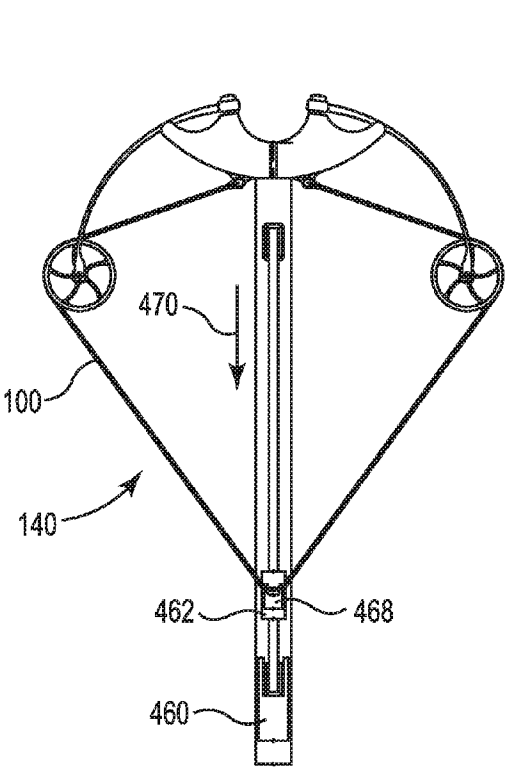
FIGS. 23A-23C illustrate a belt-driven cocking mechanism for a bow in accordance with an embodiment of the present disclosure.
Figure 23B:
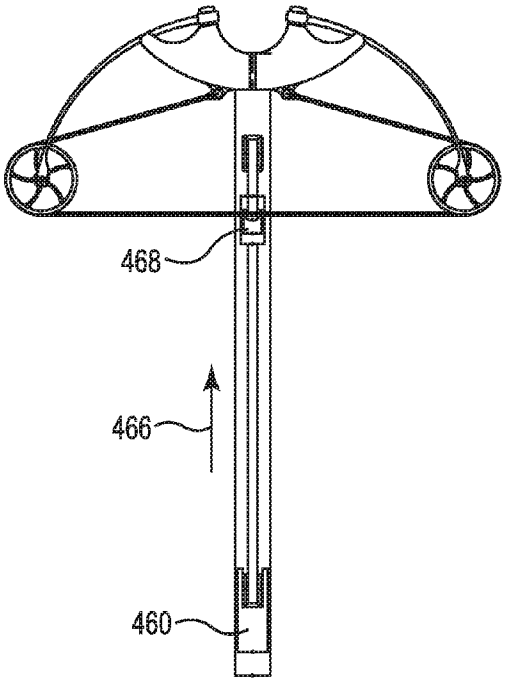
Figure 23A:
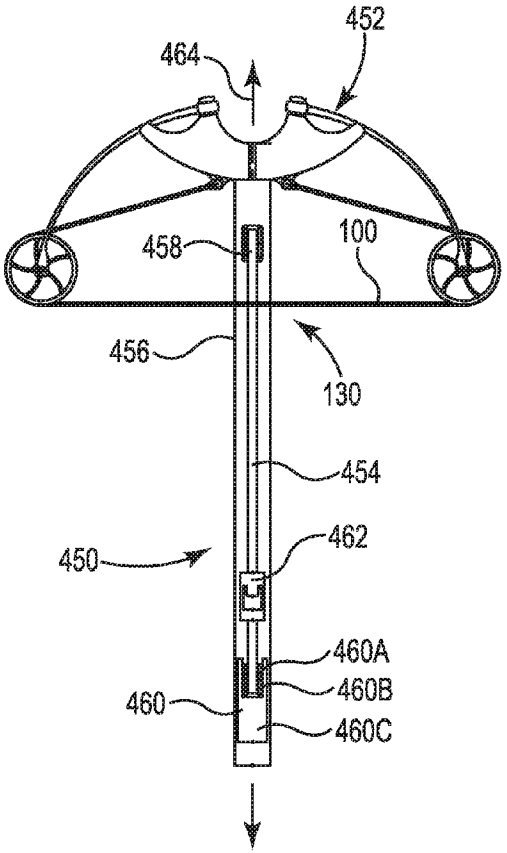
Figure 23E:
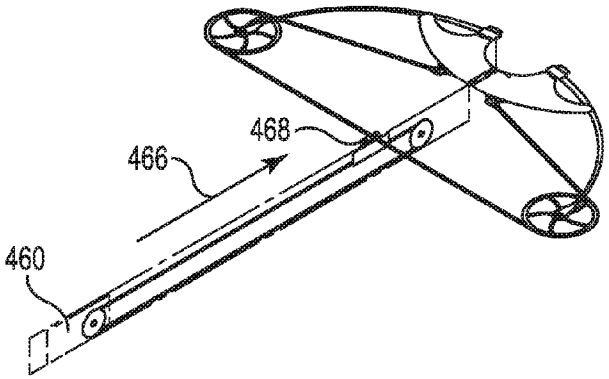
FIGS. 23D-23F are perspective views of the belt-driven cocking mechanism of FIGS. 23A-23C, respectively.
Figure 23F:
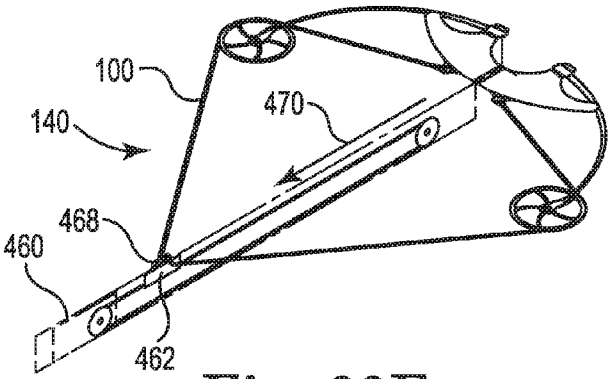
Figure 23D:
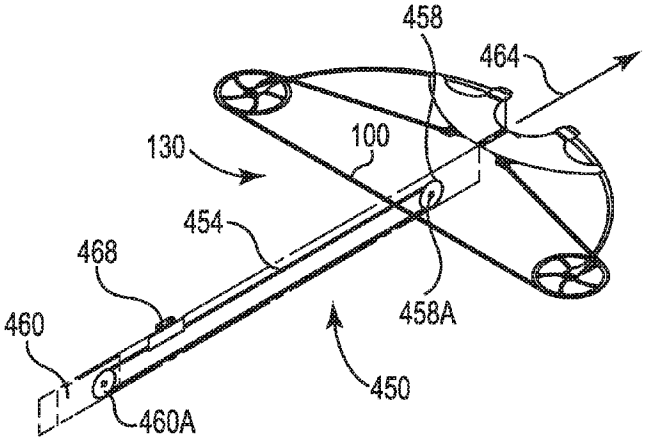

FIGS. 23A and 23D illustrate the draw string 100 in the release configuration 130. In operation, the pulleys 458A, 460A rotate to move the belt 454 and advance the traveler 462 in direction 466 until drawstring catch 468 engages the draw string 100, as illustrated in FIGS. 23B and 23E. The drawstring catch 468 preferably slides in a slot formed in the center support 456 (see e.g., FIGS. 12A).

Rotation of the belt 454 around the pulleys 458A, 460A is then reversed to move the traveler 462 in the opposite direction 470 until the draw string 100 is in the drawn configuration 140, as illustrated in FIGS. 23C and 23F. This process can also be reverse to un draw the draw string 100 from the drawn configuration 140 to the released configuration 130.

In one embodiment, the traveler 462 brings the draw string 100 into engagement with a trigger assembly (see e.g., FIG. 17). The drawstring catch 468 then releases the draw string 100, which is held in place by the trigger assembly. In another embodiment, the drawstring catch 468 operates as the trigger assembly.

In one embodiment, a brake system is provided to control rotation of the belt 454, such as a friction brake or an eddy current brake. The brake system prevents the traveler 462 from being moved in the direction 466 by the force of the draw string 100.

In another embodiment, a ratcheting system or one-way bearing is used to control movement of the traveler 462 along the length of the center support 456. (See e.g., FIGS. 14 and 15). For example, if the battery lacks sufficient power to move the traveler 462 to the fully drawing configuration, the ratcheting system or one-way bearing prevents the draw string 100 from rapidly returning to the released configuration 130.

Figure 24:
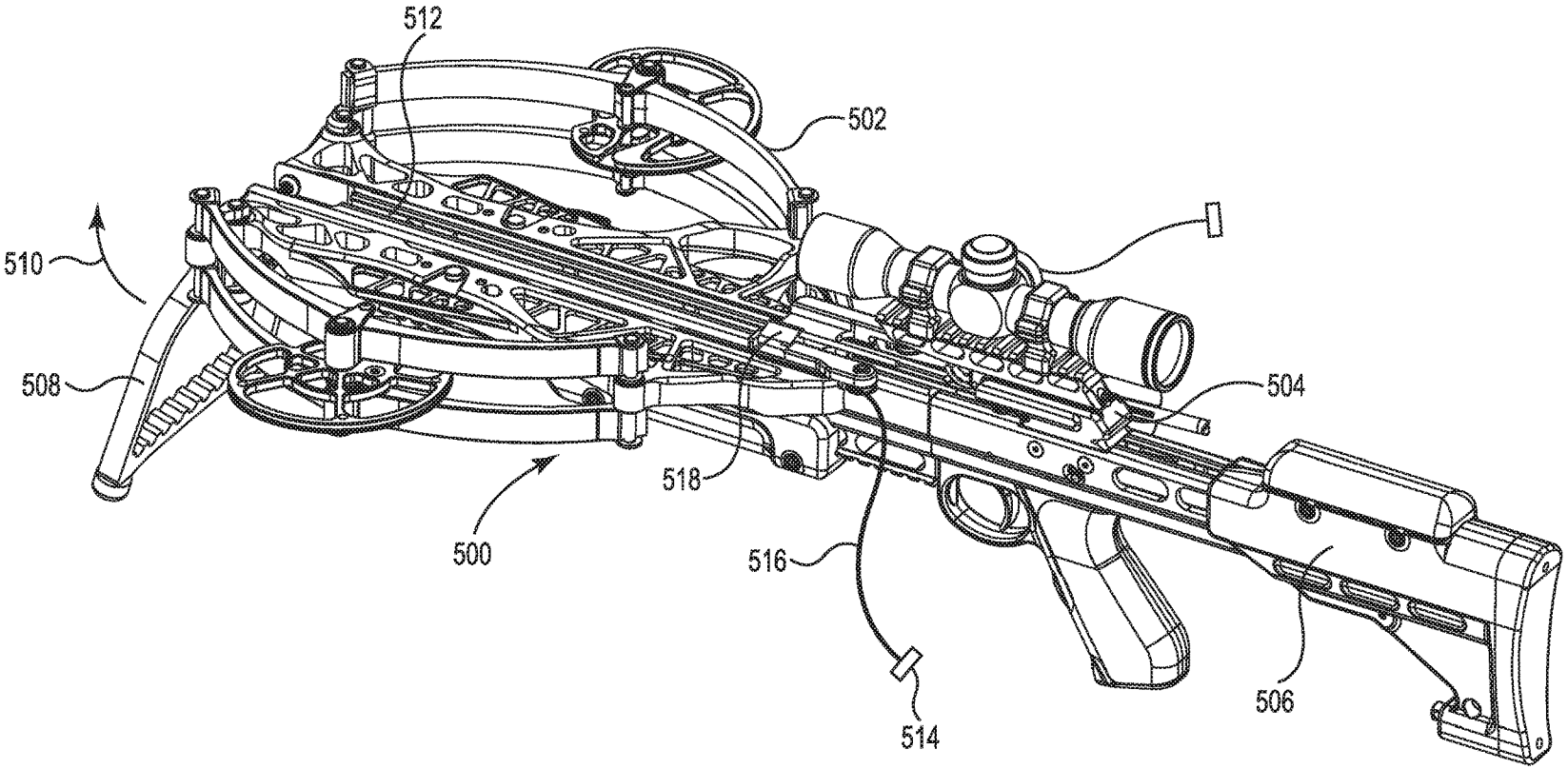
FIG. 24 is a perspective view of an alternate bow with a combined cocking and de-cocking mechanism in accordance with an embodiment of the present disclosure.
Figure 25:
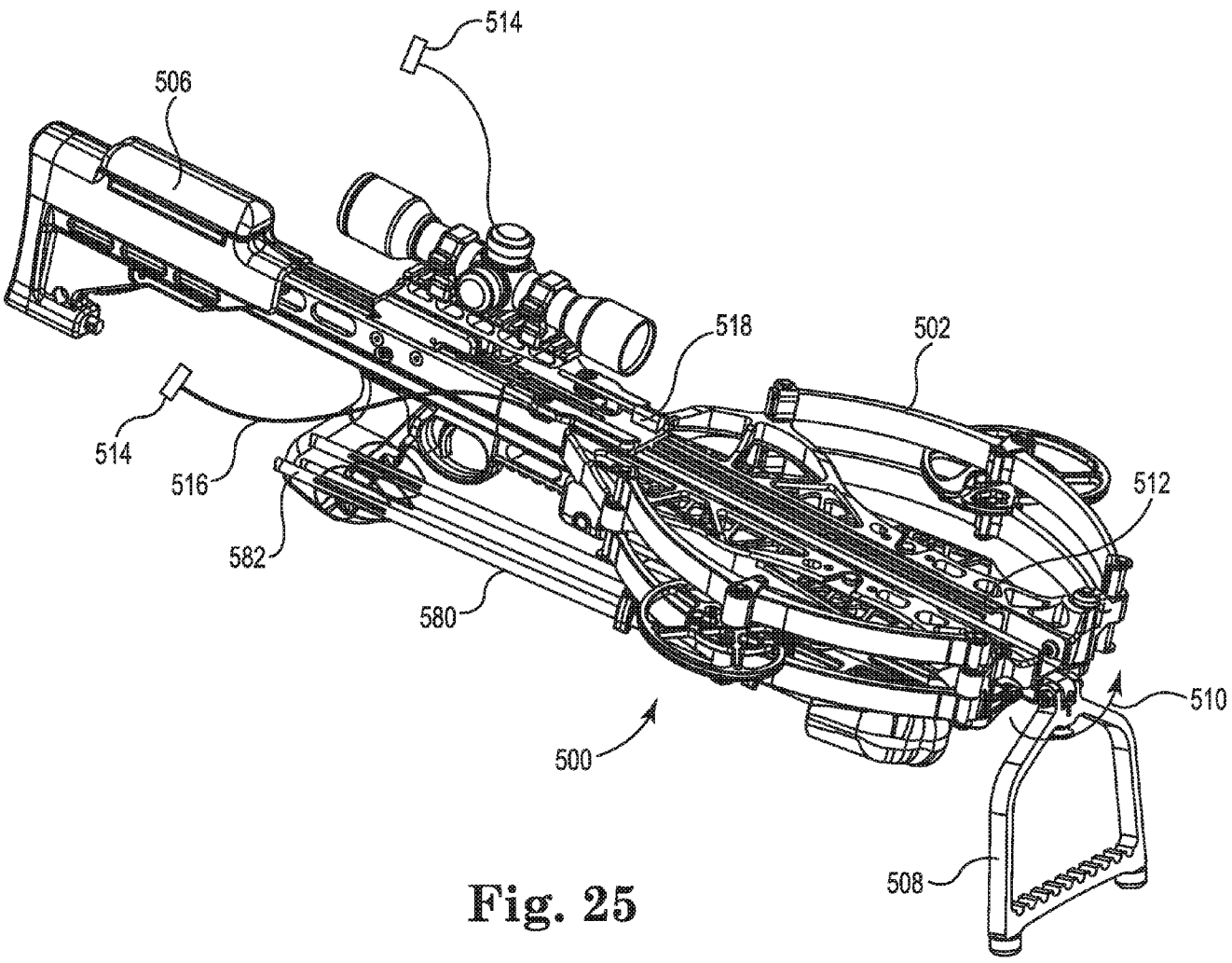
FIG. 25 is a perspective view of the bow of FIG. 24.

FIGS. 24 and 25 are perspective views of an alternate bow 500 with an energy storage device 502 in accordance with an embodiment of the present disclosure. Trigger assembly 504 with collapsible stock 506 is attached to the energy storage device 502 by center support 512. Stirrup 508 is attached at front end to secure the bow 500 to assist in the cocking procedure.

In operation, the stirrup 508 is rotated in direction 510 until it is parallel to center support 512. The user places a foot in the stirrup 508 and pulls handles 514 on the cord 516. As will be discussed below, traveler 518 moves the draw string 520 (see FIG. 26A and 26B) into engagement with the trigger assembly 504 (see FIGS. 27 and 30). After cocking the bow 500 the stirrup 508 can be folded back to the illustrated position to serve as a bi-pod for firing the bow 500.

In an alternate embodiment, one of the cocking mechanisms 200, 400, 422, 450 disclosed herein can be used to move the traveler 518 back and forth along the center support 512 between the released configuration 130 and the drawn configuration 540. The traveler 518 is preferably releasably engaged with one of the travelers 212, 412, 428, 462 on the corresponding cocking mechanisms 200, 400, 422, 450 until the draw string is positioned as desired configuration.

Figure 26A:
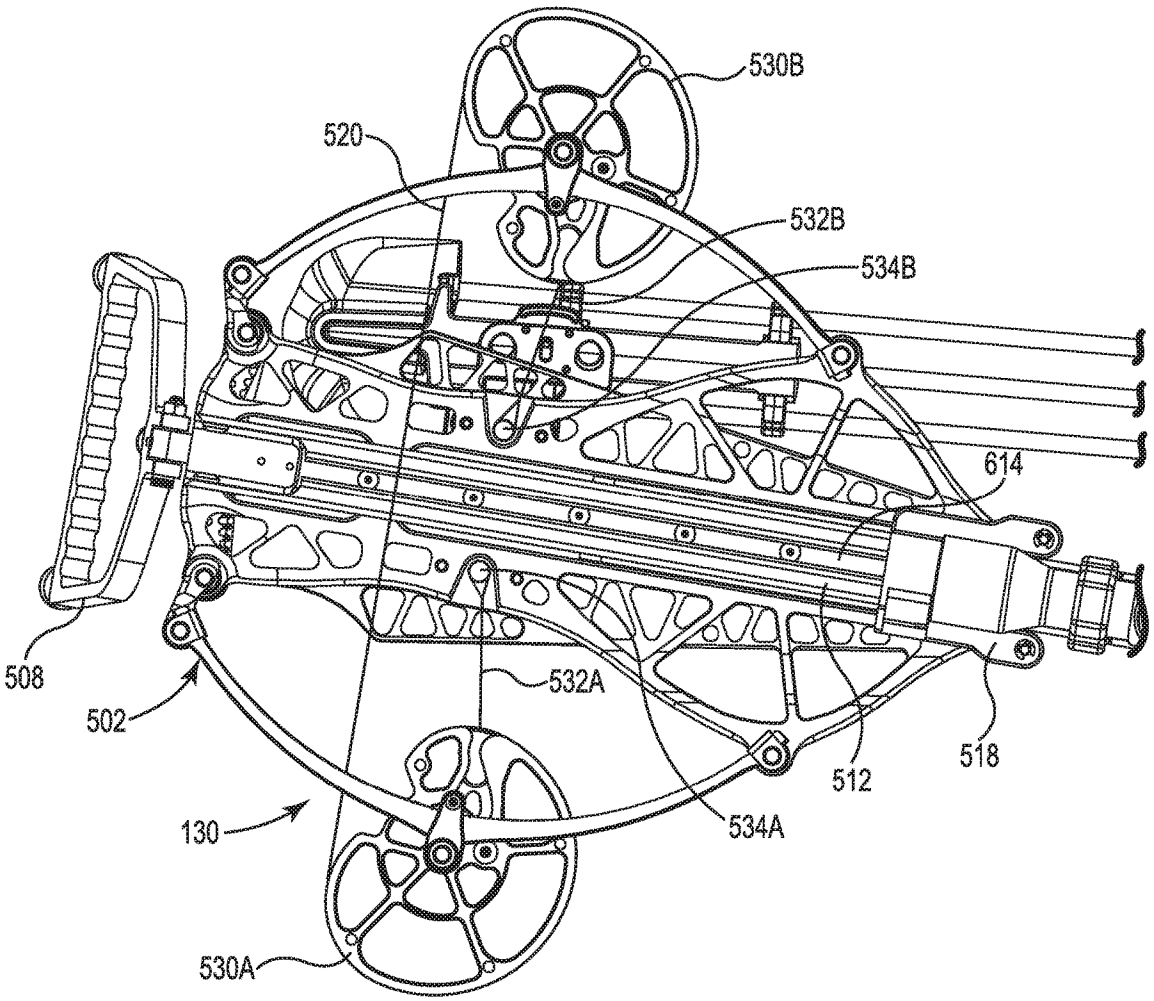
FIG. 26A is a top view of an energy storage portion of the bow of FIG. 24.
Figure 26B:
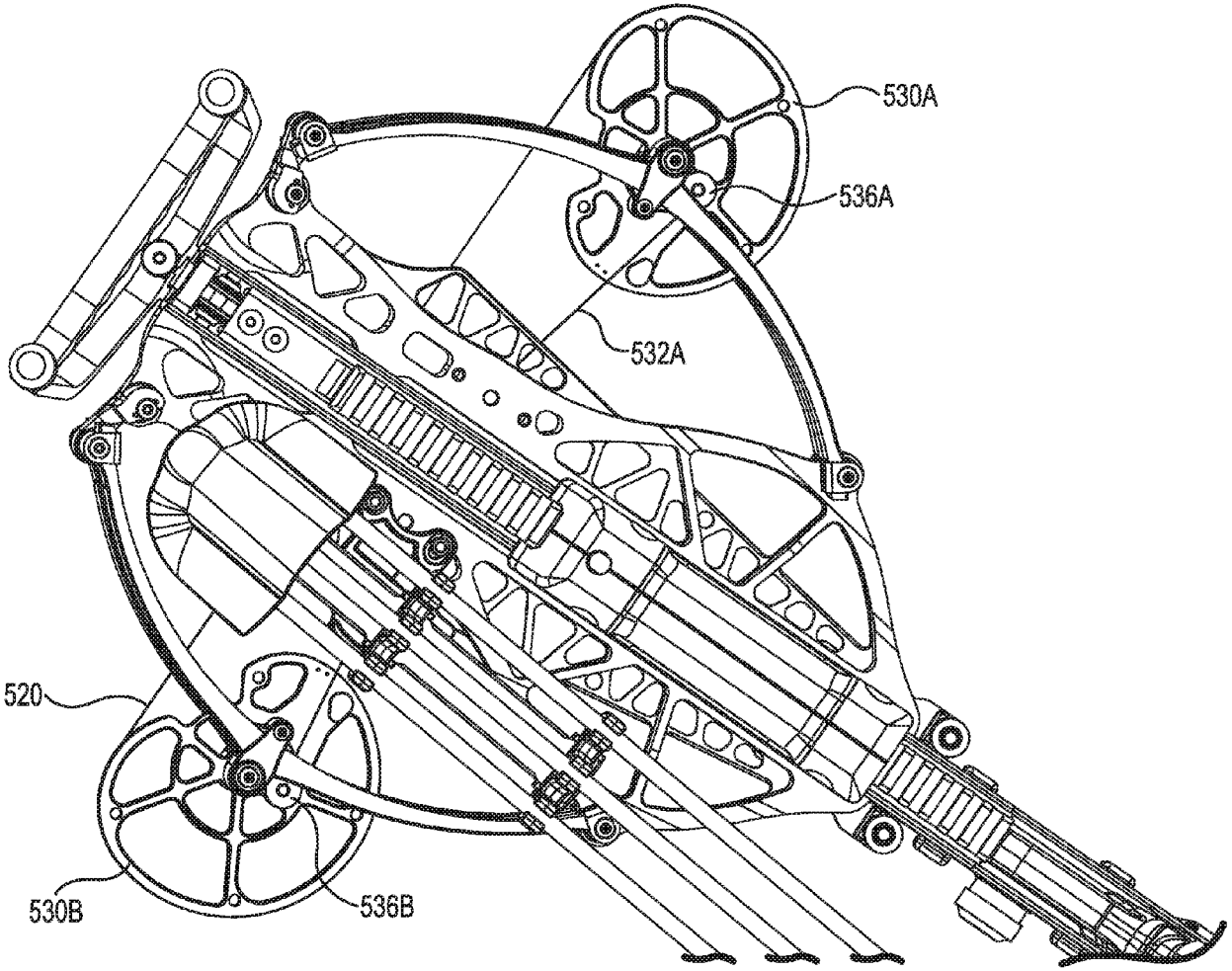
FIG. 26B is a bottom view of an energy storage portion of the bow of FIG. 24.

FIGS. 26A and 26B are top and bottom views of the energy storage device 502. Draw string 520 extends between pulleys 530A, 530B ("530"). In the illustrated embodiment, the draw string 520 is in the released configuration 130. Power strings 532A, 532B ("532") extend outward from attachment points 534A, 534B ("534") on center support 512 to attachment points 536A, 536B ("536") on the bottom of the pulleys 530A, 530B, respectively. The power strings 532 do not cross over the center support 512. In the illustrated embodiment, the no timing belt is provided between the translation arms 538A, 538B. Elimination of the timing belt is particularly effected when used with round or generally round pulleys 530.

Figure 27:
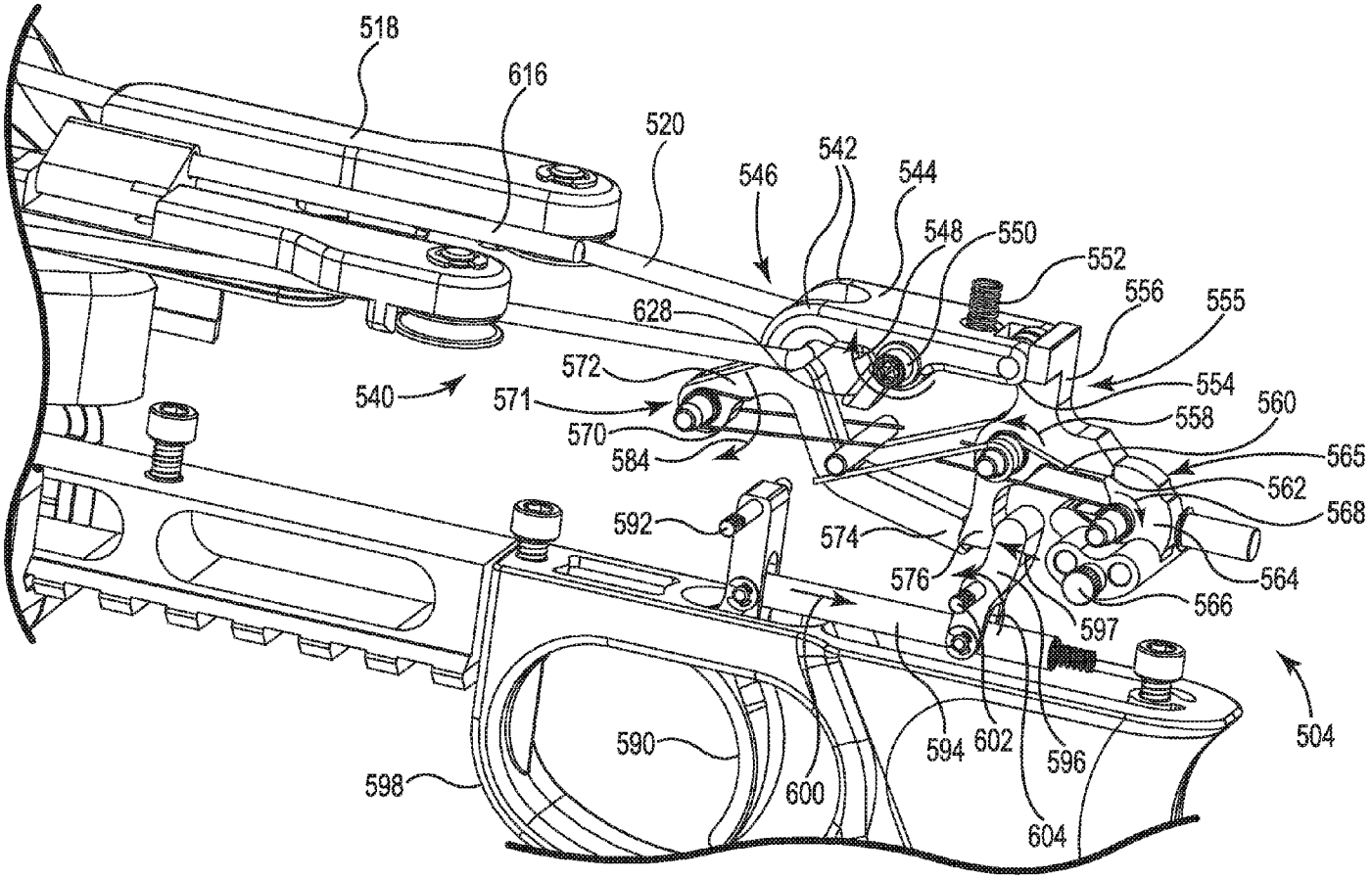
FIG. 27 is a perspective view of a trigger assembly with a draw string in a drawn configuration in accordance with an embodiment of the present disclosure.

FIG. 27 is a perspective view of the trigger assembly 504 with the housing removed. Draw string 520 is retained in the drawn configuration 540 by a pair of fingers 542 on catch 544 in closed position 546. The catch 544 is biased to rotate in direction 548 around pin 550 by spring 552. Absent an external force, the catch 544 automatically releases the draw string 520.

In cocked position 555, shoulder 554 on sear 556 provides the external force to retain the catch 544 in the closed position 546. The sear 556 is biased in direction 558 by spring 560 to retain the catch 544 in the closed position 546.

Shoulder 562 on safety 564 retains the sear 556 in the cocked position 555 and the catch 544 in the closed position 546. Safety button 566 is used to rotate the safety 564 in direction 568 from safe position 565 to free position 567 with the shoulder 562 disengaged from the sear 556 (see FIG. 28).

Spring 570 biases dry fire lockout 572 toward the intersection of the draw string 520 with the catch 544. Distal end 574 of the dry fire lockout 572 engages arm 576 on the sear 556 in a lockout position 571 to prevent the sear 556 from releasing the catch 544. Even if the safety 564 is disengaged from the sear 556, the distal end 574 of the dry fire lockout 572 locks the sear 556 in the cocked position 555 to prevent the catch 544 from releasing the draw string 520.

In use, nock 582 on a bolt 580, such as those illustrated in FIG. 25, is positioned on the center support 512 and engages the draw string 520 between the fingers 542 of the catch 544. The nock 582 also displaces the dry fire lockout 572 in direction 584 so that the distal end 574 releases the arm 576 on the sear 556 in a disengaged position 573 (See FIG. 28). Only when a bolt 580 is fully engaged with the draw string 520 will the dry fire lockout 572 permit the sear 542 to move to the fire position 569.

Trigger 590 pivots around pin 592. Trigger linkage 594 pivotally connects the trigger 590 with trigger pawl 596. Depressing the trigger 590 in the trigger guard 598 causes the trigger linkage 594 to be displaced in direction 600, which results in the trigger pawl 596 rotating around pin 602 in direction 604. The pawl 596 provides external force 597 that moves the sear 556 from the cocked position 555 to fire position 569 shown in FIG. 28 in order to fire the bow 500.

Figure 29A:
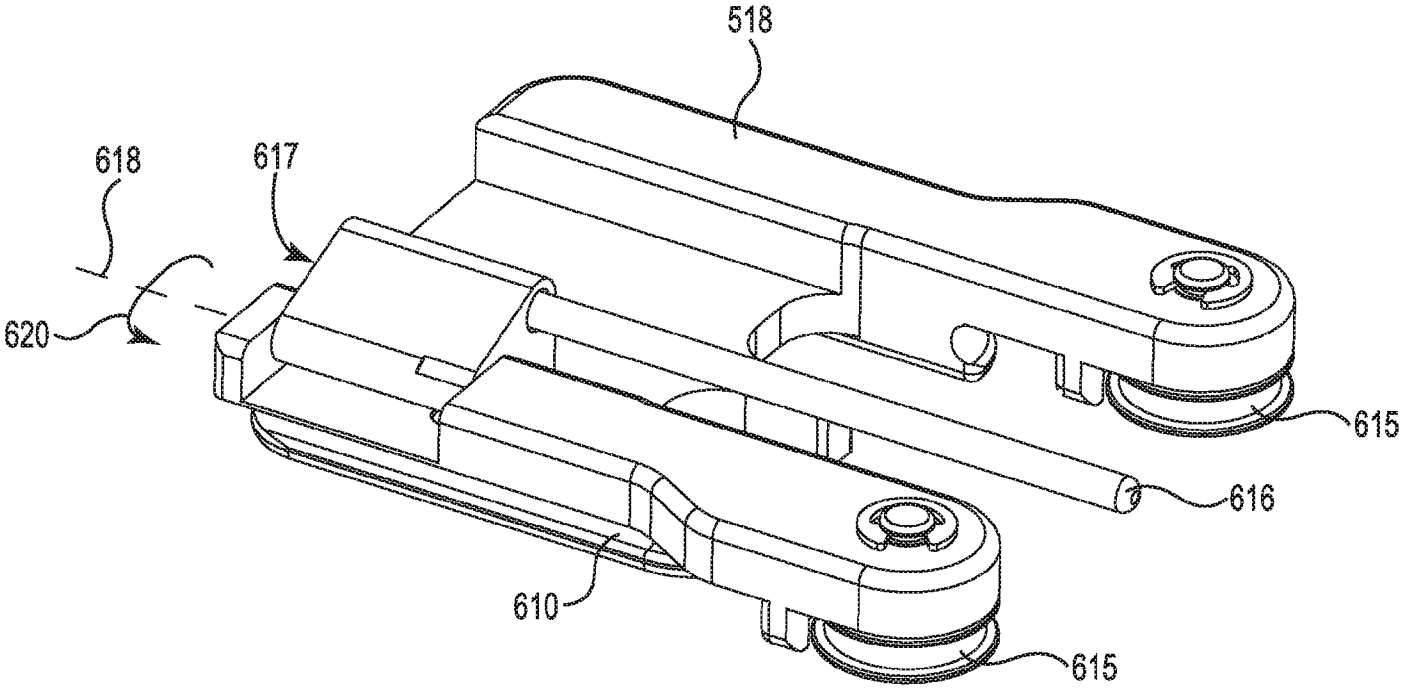
FIGS. 29A and 29B are perspective views of a traveler for a bow in accordance with an embodiment of the present disclosure.
Figure 29B:
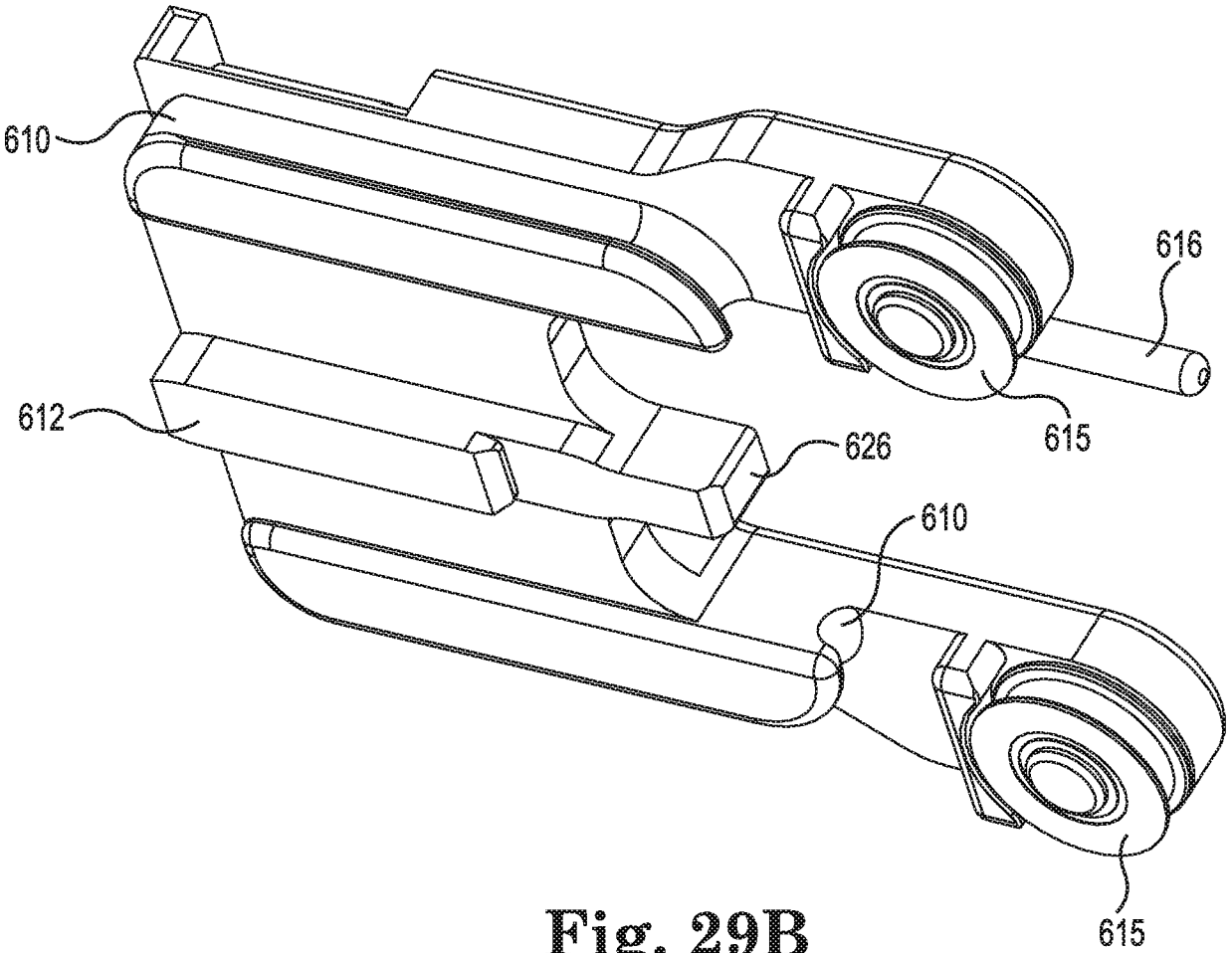

As best illustrated in FIGS. 29A and 29B, the traveler 518 includes draw string channels 610 that engage with the draw string 520, both during cocking and de-cocking of the bow 500. The cords 516 attach to pulleys 615 on the traveler 518. Guide 612 is provided on bottom of the traveler 518 that slides in the channel 614 (see FIG. 26A) in the center support 512. De-cocking actuator 616 is pivotally attached to the traveler 518 and rotates around axis 618 between active position 617 and inactive position 619 (see FIG. 30).

Figure 30:
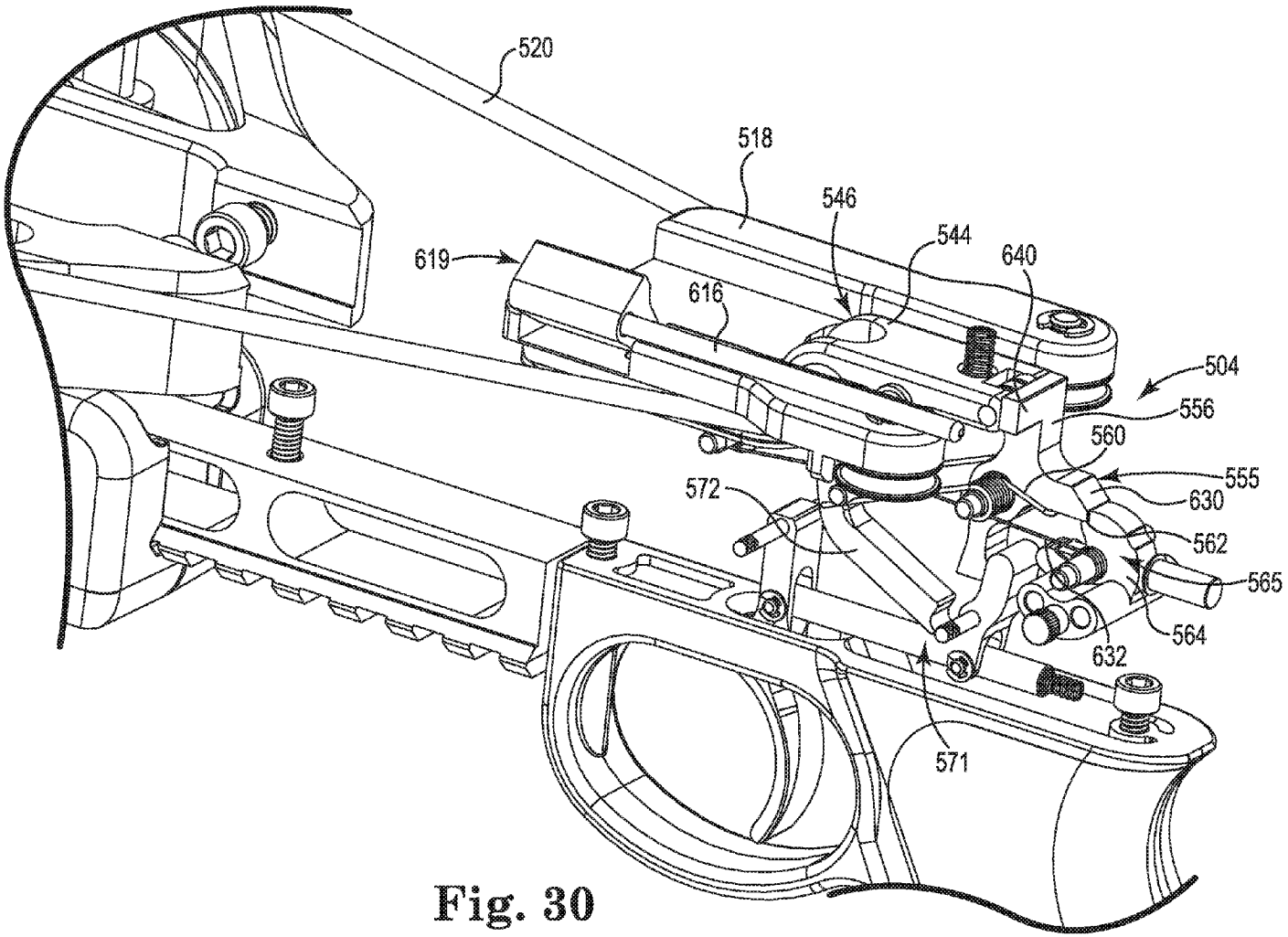
FIG. 30 is a perspective view of the trigger assembly of FIG. 27 being cocked by a cocking mechanism in accordance with an embodiment of the present disclosure.

As illustrated in FIG. 30, cocking the bow 500 requires locating the de-cocking actuator 616 in the inactive position 619 so it does not engage with the trigger assembly 504 during the cocking process. When cocking the bow 500 the trigger assembly 504 is in the open configuration 624 illustrated in FIG. 28.

As the traveler 518 advances toward the trigger assembly 504, extension 626 on the traveler 518 rotates the dry fire lockout 572 to the disengaged position 571. The draw string 520 simultaneously contacts projection 628 (see FIG. 27) on the catch 544 to move the catch 544 to the closed position 546. Spring 560 responds by rotating the sear 556 to the cocked position 555 so the catch 544 is locked in the closed position 546. In the inactive position 619 the cocking pin 616 does not engage with extension 640 on the sear 556, even when the traveler 518 is fully engaged with the trigger assembly 504.

As the sear 556 rotates to the cocked position 555, arm 630 moves the safety 564 past the detent. Spring 632 rotates the safety 564 to the safe position 565 until the shoulder 562 again locks the sear 556 in the cocked position 555. The safety 564 is preferably automatically activated whenever the bow 500 is placed in the drawn configuration 540.

Figure 28:
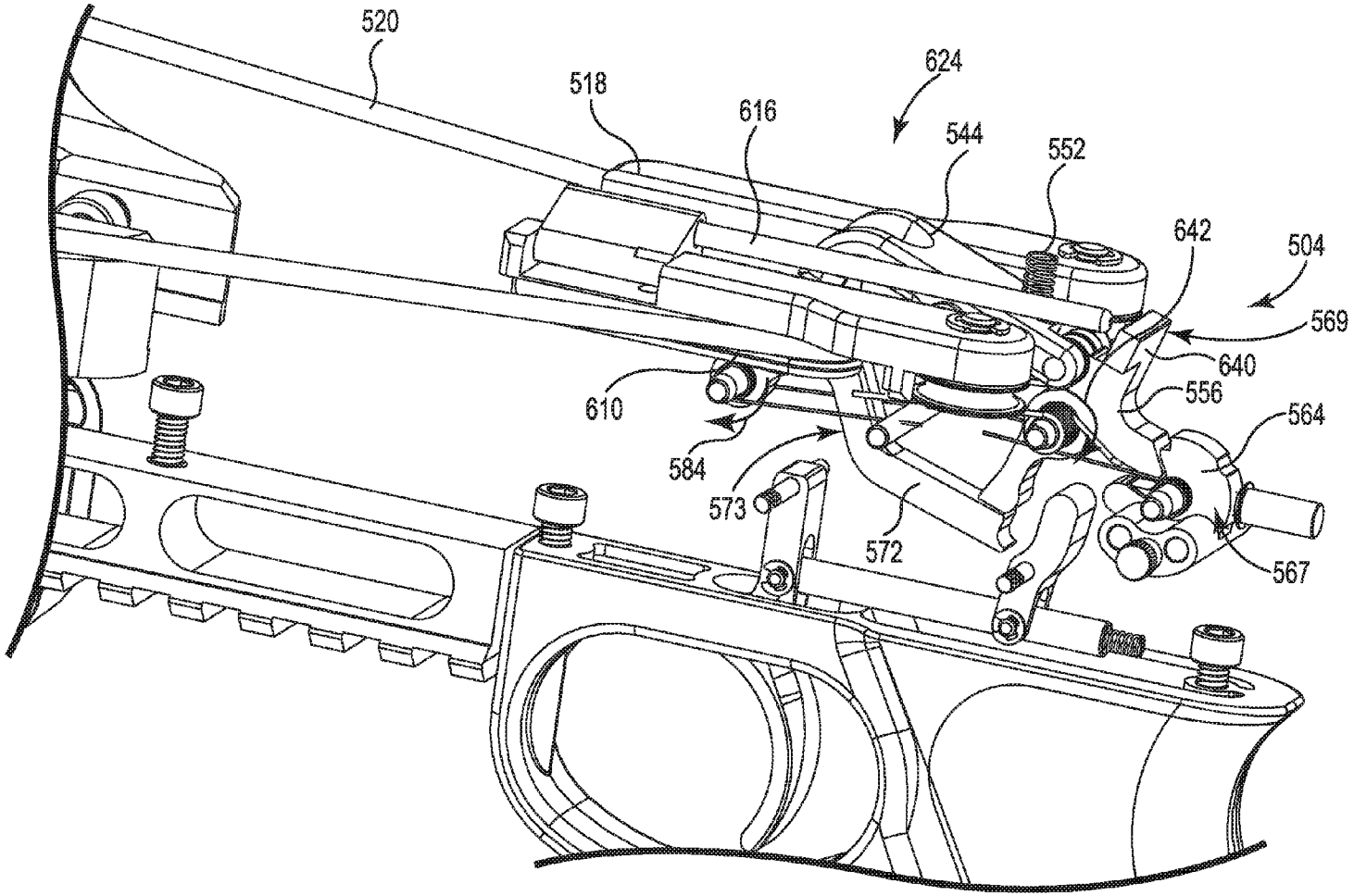
FIG. 28 is a perspective view of the trigger assembly of FIG. 27 being de-cocked in accordance with an embodiment of the present disclosure.

De-cock the bow 500 is best illustrated in FIG. 28. The user manually disengages the safety 564. The de-cocking actuator 616 is rotated into the active position 617 illustrated in FIG. 29A. The traveler 518 is engaged with the channel 614 and the cords 516 are pulled so the extension 626 on the traveler 518 rotates with the dry fire lockout 572 in direction 584. The de-cocking actuator 616 engages the extension 640 on the sear 556 to rotate the sear 556 in direction 642 to the fire position 569. Spring 552 moves the catch 544 to the open configuration 624, releasing the draw string 520 onto the channels 610 on the traveler 518. The gap between the draw string 520 and the channels 610 on the traveler 518 is preferably very small to avoid a shock load on the cords 516 when the draw string 520 is released. The user can then slowly control movement of the draw string 520 to the release configuration 130 using the cords 516.

Where a range of values is provided, it is understood that each intervening value, to the tenth of the unit of the lower limit unless the context clearly dictates otherwise, between the upper and lower limit of that range and any other stated or intervening value in that stated range is encompassed within this disclosure. The upper and lower limits of these smaller ranges which may independently be included in the smaller ranges is also encompassed within the disclosure, subject to any specifically excluded limit in the stated range. Where the stated range includes one or both of the limits, ranges excluding either both of those included limits are also included in the disclosure.

Unless defined otherwise, all technical and scientific terms used herein have the same meaning as commonly understood by one of ordinary skill in the art to which this disclosure belongs. Although any methods and materials similar or equivalent to those described herein can also be used in the practice or testing of the various methods and materials are now described. All patents and publications mentioned herein, including those cited in the Background of the application, are hereby incorporated by reference to disclose and described the methods and/or materials in connection with which the publications are cited.

The publications discussed herein are provided solely for their disclosure prior to the filing date of the present application. Nothing herein is to be construed as an admission that the present disclosure is not entitled to antedate such publication by virtue of prior invention. Further, the dates of publication provided may be different from the actual publication dates which may need to be independently confirmed.

Other embodiments are possible. Although the description above contains much specificity, these should not be construed as limiting the scope of the disclosure, but as merely providing illustrations of some of the presently preferred embodiments. It is also contemplated that various combinations or sub-combinations of the specific features and aspects of the embodiments may be made and still fall within the scope of this disclosure. It should be understood that various features and aspects of the disclosed embodiments can be combined with or substituted for one another in order to form varying modes disclosed. Thus, it is intended that the scope of at least some of the present disclosure should not be limited by the particular disclosed embodiments described above.

Thus the scope of this disclosure should be determined by the appended claims and their legal equivalents. Therefore, it will be appreciated that the scope of the present disclosure fully encompasses other embodiments which may become obvious to those skilled in the art, and that the scope of the present disclosure is accordingly to be limited by nothing other than the appended claims, in which reference to an element in the singular is not intended to mean "one and only one" unless explicitly so stated, but rather "one or more." All structural, chemical, and functional equivalents to the elements of the above-described preferred embodiment that are known to those of ordinary skill in the art are expressly incorporated herein by reference and are intended to be encompassed by the present claims. Moreover, it is not necessary for a device or method to address each and every problem sought to be solved by the present disclosure, for it to be encompassed by the present claims. Furthermore, no element, component, or method step in the present disclosure is intended to be dedicated to the public regardless of whether the element, component, or method step is explicitly recited in the claims.

What is claimed is:

1. A cocking mechanism for a crossbow comprising:

a center support including longitudinal axis;

an energy storage assembly coupled to the center support with a draw string that extends across the center support coupled to the energy storage assembly;

an elongated handle pivotally attached to the center support at location near a distal end of the center support;

a traveler that slides along the center support back and forth along the longitudinal axis in a channel formed in the center support;

an arm having a first end pivotally coupled to the elongated handle and a second end pivotally coupled to the traveler, wherein the portion of the arm pivotally coupled to the traveler moves in the channel with the traveler as the elongated handle is moved between a closed configuration and an open configuration, and wherein as the elongated handle is moved by a user to the open configuration the arm advances the traveler in the channel to the distal end of the center support and into engagement with the draw string in a release configuration, and as the elongated handle is moved by a user to the closed configuration the arm pulls the draw string and the traveler from the released configuration to a drawn configuration, and the draw string into engagement with a trigger assembly located near a proximal end of the center support;

a latch that retains the elongated handle in the closed configuration;

a ratcheting mechanism that prevents the elongated handle from moving to the open configuration as the elongated handle is being moved toward the closed configuration; and a thumb trigger located near a proximal end of the elongated handle coupled to the latch and the ratcheting mechanism, wherein actuating the thumb trigger releases the latch and the ratcheting mechanism.

2. The cocking mechanism of claim 1 comprising an opening in the center support that receives a portion of the cocking mechanism.

3. The cocking mechanism of claim 1 an accessory rail suitable for attaching crossbow accessories to the crossbow is attached to the elongated handle.

4. The cocking mechanism of claim 1 wherein the traveler including a finger that captures the draw string and pulls it into engagement with the trigger assembly.

5. The cocking mechanism of claim 1 comprising a latch that retains the elongated handle in the closed configuration.

6. The cocking mechanism of claim 1 comprising a ratcheting mechanism that prevents the elongated handle from moving toward the open configuration as it is being moved toward the closed configuration.

7. The cocking mechanism of claim 1 comprising a ratcheting mechanism located at the pivotal intersection of the arm with the elongated handle.

8. The cocking mechanism of claim 1 comprising:

a toothed member mounted to the elongated handle; and a pawl pivotally attached to the arm and biased into engagement with teeth on the toothed member so the pawls slide sequentially into and out of engagement with the teeth as the elongated handle is moved from the open configuration to the closed configuration, the pawl preventing movement of the elongated handle toward the open configuration.

9. The cocking mechanism of claim 8 comprising an thumb trigger located near a proximal end of the elongated handle coupled to the pawl, wherein actuating the thumb trigger disengages the pawl from the teeth.

10. The cocking mechanism of claim 1 wherein the traveler is constrained within the channel as it moves back and forth along the longitudinal axis of the center support.

11. A cocking mechanism for a crossbow comprising:

a center support including a longitudinal axis;

at least first and second limbs attached to the center support;

first and second power cables extending between the first and second limbs and the center support, respectively, wherein the first and second power cables do not cross over the center support;

an elongated handle pivotally attached to the center support at location near a distal end;

a traveler that slides support back and forth along the longitudinal axis of the center support in a channel formed in the center support;

an arm having a first end pivotally coupling the elongated handle and a second end pivotally coupled to the traveler, wherein the portion of the arm pivotally coupled to the traveler moves in the channel with the traveler as the elongated handle is moved between a closed configuration and an open configuration and wherein as the elongated handle is moved by a user to the open configuration the arm advances the traveler in the channel to the distal end of the center support and into engagement with the draw string, and as the elongated handle is moved by a user to the closed configuration the arm pulls the draw string from a released configuration to a drawn configuration, and into engagement with a trigger assembly located near a proximal end of the center support;

a latch that retains the elongated handle in the closed configuration;

a ratcheting mechanism that prevents the elongated handle from moving to the open configuration as the elongated handle is being moved toward the closed configuration; and a thumb trigger located near a proximal end of the elongated handle coupled to the latch and the ratcheting mechanism, wherein actuating the thumb trigger releases the latch and the ratcheting mechanism.

12. A method of operating a cocking mechanism for a crossbow, the crossbow including a center support with a longitudinal axis and an energy storage assembly engaged with the center support with a draw string that extends across the center support coupled to the energy storage assembly, the method comprising the steps of:

manually moving an elongated handle pivotally attached near a distal end of the center support toward an open configuration, the elongated handle is pivotally coupled to a traveler by an arm, the arm having a first end pivotally coupled to the elongated handle and a second end pivotally coupled to the traveler;

sliding the traveler along the longitudinal axis in a channel formed in the center support to the distal end of the center support in response to moving the elongated handle to the open configuration, wherein a portion of the arm pivotally coupled to the traveler moves in the channel formed in the center support with the traveler;

coupling the traveler to the draw string in a released configuration;

manually moving the elongated handle to a closed configuration to pull the traveler and the draw string toward a drawn configuration;

engaging a latch to retain the elongated handle in the closed configuration;

activating a ratcheting mechanism to prevent the elongated handle from moving to the open configuration while cocking the crossbow;

actuating a thumb trigger located near a proximal end of the elongated handle coupled to the latch that disengages the latch and the ratcheting mechanism during the step of moving the elongated handled toward the open configuration; and engage the draw string with a trigger assembly located near a proximal end of the center support.

13. The method of claim 12 comprising locating a portion of the cocking mechanism in an opening in the center support when in the closed configuration.

14. The method of claim 12 comprising engaging a ratcheting mechanism during the step of moving the elongated handle to a closed configuration to prevent the elongated handle from moving toward the open configuration.

15. The method of claim 12 comprising the steps of engaging a pawl attached to the arm with teeth on the toothed member attached to the elongated handle so the pawls slide sequentially into and out of engagement with the teeth as the elongated handle is moved from the open configuration to the closed configuration, while preventing movement of the elongated handle toward the open configuration.

16. The method of claim 15 comprising actuating an thumb trigger located near a proximal end of the elongated handle coupled to the pawl that disengages the pawl from the teeth during the step of moving an elongated handle toward the open configuration.

* * * * *